US009222274B1

(12) United States Patent
Goettl et al.

(10) Patent No.: US 9,222,274 B1
(45) Date of Patent: Dec. 29, 2015

(54) ANGLED POOL VALVE MODULE

(71) Applicant: GSG Holdings, Inc., Chandler, AZ (US)

(72) Inventors: John M. Goettl, Phoenix, AZ (US); Steve Sharp, Phoenix, AZ (US)

(73) Assignee: GSG Holdings, Inc., Chandler, AZ (US)

( * ) Notice: Subject to any disclaimer, the term of this patent is extended or adjusted under 35 U.S.C. 154(b) by 140 days.

(21) Appl. No.: 14/014,214

(22) Filed: Aug. 29, 2013

Related U.S. Application Data

(60) Provisional application No. 61/697,258, filed on Sep. 5, 2012.

(51) Int. Cl.
*E04H 4/16* (2006.01)

(52) U.S. Cl.
CPC ..... *E04H 4/16* (2013.01); *Y10T 137/86493* (2015.04)

(58) Field of Classification Search
CPC ..... E04H 4/16; F16K 11/074; F16K 11/076; F16K 11/0746
USPC ..... 137/625
See application file for complete search history.

(56) References Cited

U.S. PATENT DOCUMENTS

| | | | | |
|---|---|---|---|---|
| 3,863,675 | A * | 2/1975 | Wiltshire | 137/624.27 |
| 4,077,424 | A * | 3/1978 | Ehret et al. | 137/119.07 |
| 4,313,455 | A * | 2/1982 | Pitman | 137/119.07 |
| 4,523,606 | A * | 6/1985 | Gould et al. | 137/119.07 |
| 4,570,663 | A * | 2/1986 | Gould et al. | 137/119.07 |
| 4,592,379 | A * | 6/1986 | Goettl | 137/119.07 |
| 4,817,656 | A * | 4/1989 | Gould | 137/2 |
| 5,093,950 | A * | 3/1992 | Heier | 15/1.7 |
| 5,197,158 | A * | 3/1993 | Moini | 15/1.7 |
| 6,189,556 | B1 * | 2/2001 | Blake et al. | 137/119.07 |
| 6,311,728 | B1 * | 11/2001 | Goettl et al. | 137/627 |
| 6,314,999 | B1 * | 11/2001 | Conn | 137/627 |
| 6,325,087 | B1 * | 12/2001 | Tarr | 137/1 |
| 6,360,767 | B1 * | 3/2002 | Barnes | 137/119.07 |
| 6,386,232 | B2 * | 5/2002 | Serrano Sanchez et al. | 137/624.14 |
| 6,539,967 | B2 * | 4/2003 | Tarr | 137/1 |
| 2006/0143841 | A1 * | 7/2006 | Niewiarowski | 15/1.7 |
| 2011/0225717 | A1 * | 9/2011 | Malinasky, Jr. | 4/496 |

* cited by examiner

*Primary Examiner* — Craig Schneider
*Assistant Examiner* — Kevin Barss
(74) *Attorney, Agent, or Firm* — Booth Udall Fuller, PLC

(57) ABSTRACT

A pool valve module includes a conical outer plate, a conical slider plate, and an impeller. The outer plate includes an inlet port near a narrow end of the outer plate and a plurality of elongated outlet ports extending through the outer plate. The slider plate is rotatable within the outer plate and includes a slider plate outlet and a slider plate inlet. The impeller is rotatably coupled to the slider plate, and the slider plate rotates within the outer plate responsive to rotation of the impeller. The slider plate rotates between at least three positions: a first position that distributes water through a first outlet port but no other ports; a second position that distributes water through the first and second outlet ports but not other outlet ports; and a third position that distributes water through the second outlet port but no other outlet ports.

27 Claims, 15 Drawing Sheets

ANGLED POOL VALVE MODULE

CROSS REFERENCE TO RELATED APPLICATIONS

This document claims the benefit of the filing date of U.S. Provisional Patent Application 61/697,258, entitled "Angled Pool Valve Assembly" to Goettl that was filed on Sep. 5, 2012, the contents of which are hereby incorporated by reference.

BACKGROUND

1. Technical Field

Aspects of this document relate generally to pool cleaning system valve assemblies.

2. Background Art

In conventional pool cleaning system valve assemblies, rotation of the valve assembly is dependent upon water flow through the assembly. The water flow must continue in order to maintain rotation of the impeller and the gearing mechanism. Conventional pool valve assemblies include round pipe fittings connected to the valve. Overlap of the adjacent valve ports with the valve as it rotates is nearly constant. This overlap with adjacent ports reduces the power or pressure of the water flowing through each port because the water flow is split between two ports rather than just flowing directly through one. Furthermore, the footprint of the valve assembly is relatively large and becomes larger with each port added to the round array.

Pool valve assemblies are typically also very difficult to repair and/or remove. This is a result of the coupling of the valve housing, which houses all of the wear surfaces within the valve, directly to the plumbing. When the wear surfaces become damaged and/or broken, the wear parts must be cut off and an entirely new base glued to the plumbing.

SUMMARY A

In a first aspect, a pool valve assembly comprises a valve module comprising a conical outer plate comprising an inlet port proximate a narrow end of the conical outer plate, and a plurality of elongated outlet ports each extending through the outer plate and having a width dimension smaller than its length dimension, a conical slider plate rotatably positioned within the outer plate and comprising a slider plate outlet extending through the slider plate and a slider plate inlet proximate a narrow end of the conical slider plate, the slider plate inlet positioned adjacent to the inlet port of the outer plate such that the slider plate inlet and the outer plate inlet are in fluid communication, and an impeller rotatably coupled to the slider plate, the impeller rotatably responsive to water flowing into the slider plate inlet to rotate the slider plate from a first position that allows fluid communication between a first elongated outlet port of the plurality of elongated outlet ports and the slider plate outlet but prevents fluid communication between at least a second elongated outlet port of the plurality of elongated outlet port and the slider plate outlet, to a second position that allows fluid communication between the first and second elongated outlet ports and the slider plate outlet, and to at least a third position that allows fluid communication between the second elongated outlet port and the slider plate outlet but prevents fluid communication between the first elongated outlet port and the slider plate outlet.

Particular embodiments and implementations may comprise one or more of the following. The pool valve module may further comprise an impeller gear coupled to the impeller, a drive train coupled to the slider plate and comprising one or more gears, the one or more gears engaged with the impeller gear and rotatable responsive to rotation of the impeller, and a ring gear coupled to the outer plate and comprising a plurality of ridges that engage with the one or more gears of the drive train as the impeller rotates the one or more gears of the drive train, the ring gear rotating the slider plate responsive to rotation of the one or more gears engaged with the plurality of ridges of the ring gear. The length dimension of each of the plurality of elongated outlet ports may be at least two times greater than the width dimension of each of the plurality of elongated outlet ports, and the slider plate is in each of the first and third positions approximately three times longer than the second position when the impeller rotates at a substantially constant rate. A base may be removably coupled to the outer plate and a cover removably coupled to at least one of the base and the ring gear, the base comprising a conical body sized to allow the outer plate to nest at least partially within the conical body, an inlet pipe positioned proximate a narrow end of the conical body and aligned with the inlet port of the outer plate to allow fluid communication between the inlet pipe and the inlet port, and a plurality of outlet pipes equal in number to the plurality elongated outlet ports and aligned with the plurality of outlet pipes, each outlet pipe being in fluid communication with a different elongated outlet port of the plurality of outlet ports, wherein each outlet pipe comprises a circular area equal to or less than an area of the elongated outlet port to which it is aligned. A plurality of lips, each one of the plurality of lips extending from an outer surface of the outer plate and at least partially surrounding a different one of the plurality of elongated outlet ports, and a plurality of lip receivers, each one of the plurality of lip receivers positioned between the conical body and a different one of the outlet pipes of the base and shaped to receive a different one of the plurality of lips. An activation switch positioned on an exterior surface of the cover and operably coupled to the impeller to prevent rotation of the impeller when the switch is in a pause position. The impeller may comprise a variable pitch impeller comprising a plurality of impeller blades each adjustable between a full speed forward position, a feathered position, and a full speed reverse position responsive to actuation of an actuator positioned within a housing of the impeller by a pushrod extending outside the valve module. A bowl-shaped shroud may be positioned at least partially within the slider plate and coupled to the narrow end of the slider plate, the shroud comprising a shroud opening in fluid communication with the slider plate inlet, the shroud increasing a velocity of water flow into the impeller responsive to water flowing through the slider plate inlet and the shroud opening, and a pre-swirler apparatus mounted at least partially within the shroud, the pre-swirler comprising one or more pre-swirler blades extending from an outer surface of the pre-swirler, the pre-swirling blades directing water flow into the impeller responsive to water flowing through the slider plate inlet and the shroud opening.

In an aspect, a pool cleaning system may comprise a pump, a plurality of cleaning valves, a base comprising a conical body, an inlet pipe positioned proximate a narrow end of the conical body and in fluid communication with the pump through a pump pipe, and a plurality of outlet pipes in fluid communication with the plurality of cleaning valves through a plurality of cleaning pipes, and a pool valve modulea conical outer plate positioned at least partially within the conical body of the base and comprising a plurality of elongated outlet ports each extending through the outer plate and in fluid communication with a different one of the plurality of outlet pipes and the inlet pipe, each one of the plurality of elongated outlet ports comprising an area greater than or substantially equal to a circular area of the outlet pipe with which it is in fluid communication, a conical slider plate rotatably positioned within the outer plate and comprising a slider plate outlet extending through the slider plate and a slider plate inlet proximate a narrow end of the slider plate, the slider plate inlet positioned adjacent to the inlet port such that the slider plate outlet is in fluid communication with the inlet port through the slider plate inlet, and an impeller rotatably coupled to the slider plate and rotatably responsive to water flow from the pump entering the valve module through the inlet port to rotate the slide plate within the outer plate from a first position to a second position.

Particular implementations and embodiments may comprise one or more of the following. The pool valve module may further comprise an impeller gear coupled to the impeller, a drive train coupled to the slider plate and comprising one or more gears engaged with the impeller gear such that the one or more gears rotate responsive to rotation of the impeller, a ring gear coupled to the outer plate and comprising a plurality of ridges that engage with the one or more gears of the gear train as the impeller rotates the one or more gears of the drive train, the ring gear rotating the slider plate responsive to rotation of the one or more gears engaged with the plurality of ridges of the ring gear, and a cover removably coupled to at least one of the base and the ring gear. A length dimension of each of the plurality of elongated outlet ports is at least two times greater than a width dimension of each of the plurality of elongated outlet ports, and the slider plate is in each of the first and third positions approximately three times longer than the first position when the impeller rotates responsive to water flow from the pump entering the valve module through the valve port. A plurality of lips, each one of the plurality of lips extending from an outer surface of the outer plate and at least partially surrounding a different one of the plurality of elongated outlet ports, and a plurality of lip receivers, each one of the plurality of lip receivers positioned between the conical body and a different one of the outlet pipes of the base and shaped to receive a different one of the plurality of lips. A switch positioned on an exterior surface of the cover and operably coupled to the impeller to prevent rotation of the impeller when the switch is in a pause position. The impeller may comprise a variable pitch impeller comprising a plurality of impeller blades each adjustable between a full speed forward position, a feathered position, and a full speed reverse position responsive to actuation of an actuator positioned within a housing of the impeller by a push rod extending outside the valve module. A bowl-shaped shroud may be positioned at least partially within the slider plate and coupled to the narrow end of the slider plate, the shroud comprising a shroud opening in fluid communication with the slider plate inlet, the shroud increasing a velocity of water flow into the impeller responsive to water flowing through the slider plate inlet and the shroud opening, and a pre-swirler apparatus mounted at least partially within the shroud, the pre-swirler comprising one or more pre-swirler blades extending from an outer surface of the pre-swirler, the pre-swirling blades directing water flow into the impeller responsive to water flowing through the slider plate inlet and the shroud opening.

In an aspect, a pool valve assembly may comprise a valve module comprising an outer plate comprising a central inlet port and a plurality of elongated outlet ports each extending through the outer plate and having a width dimension smaller than its length dimension, a slider plate rotatably positioned adjacent the outer plate and comprising a slider plate outlet extending through the slider plate and a slider plate inlet positioned adjacent to the inlet port of the outer plate such that the slider plate inlet and the outer plate inlet are in fluid communication, and an impeller rotatably coupled to the slider plate, the impeller rotatably responsive to water flowing into the slider plate inlet to rotate the slider plate from a first position that allows fluid communication between a first elongated outlet port of the plurality of elongated outlet ports and the slider plate outlet but prevents fluid communication between at least a second elongated outlet port of the plurality of elongated outlet port and the slider plate outlet, to a second position that allows fluid communication between the first and second elongated outlet ports and the slider plate outlet, and to at least a third position that allows fluid communication between the second elongated outlet port and the slider plate outlet but prevents fluid communication between the first elongated outlet port and the slider plate outlet.

Particular embodiments and implementations may comprise one or more of the following. An impeller gear coupled to the impeller, a drive train coupled to the slider plate and comprising one or more gears, the one or more gears engaged with the impeller gear and rotatable responsive to rotation of the impeller, and a ring gear coupled to the outer plate and comprising a plurality of ridges that engage with the one or more gears of the drive train as the impeller rotates the one or more gears of the drive train, the ring gear rotating the slider plate responsive to rotation of the one or more gears engaged with the plurality of ridges of the ring gear. The length dimension of each of the plurality of elongated outlet ports may be at least two times greater than the width dimension of each of the plurality of elongated outlet ports, and the slider plate is in each of the first and third positions approximately three times longer than the second position when the impeller rotates at a substantially constant rate. A base may be removably coupled to the outer plate and a cover removably coupled to at least one of the base and the ring gear, the base comprising a body positioned adjacent the outer plate, an inlet pipe aligned with the inlet port of the outer plate to allow fluid communication between the inlet pipe and the inlet port, and a plurality of outlet pipes equal in number to the plurality elongated outlet ports and aligned with the plurality of outlet pipes, each outlet pipe being in fluid communication with a different elongated outlet port of the plurality of outlet ports, wherein each outlet pipe comprises a circular area equal to or less than an area of the elongated outlet port to which it is aligned. A plurality of lips, each one of the plurality of lips extending from an outer surface of the outer plate and at least partially surrounding a different one of the plurality of elongated outlet ports, and a plurality of lip receivers, each one of the plurality of lip receivers positioned between the body of the base and a different one of the outlet pipes of the base and shaped to receive a different one of the plurality of lips. An activation switch positioned on an exterior surface of the cover and operably coupled to the impeller to prevent rotation of the impeller when the switch is in a pause position, and wherein body of the base comprises a frustoconical body, the outer plate comprises a frustoconical outer plate at least partially nesting within the body of the base, and the slider plate comprises a frustoconical slider plate at least partially nesting within the outer plate. The impeller may comprise a variable pitch impeller comprising a plurality of impeller blades each adjustable between a full speed forward position, a feathered position, and a full speed reverse position responsive to actuation of an actuator positioned within a housing of the impeller by a pushrod extending outside the valve module. A bowl-shaped shroud positioned at least partially within the slider plate and coupled to a narrow end of the slider plate, the shroud comprising a shroud opening in fluid communication with the slider plate inlet, the shroud increasing a velocity of water flow into the impeller responsive to water flowing through the slider plate inlet and the shroud opening, and a pre-swirler apparatus mounted at least partially within the shroud, the pre-swirler comprising one or more pre-swirler blades extending from an outer surface of the pre-swirler, the pre-swirling blades directing water flow into the impeller responsive to water flowing through the slider plate inlet and the shroud opening.

In an aspect, a method of sequentially distributing water from an inlet pipe to a plurality of outlet pipes in a pool valve assembly, comprising receiving water from a pump into a pool valve module, the water entering the pool valve module through an inlet port of a conical outer plate of the pool valve module and a slider plate inlet of a slider conical slider plate of the pool valve module, rotating an impeller positioned within the pool valve module responsive to water entering the pool valve module, rotating the conical slider plate responsive to rotation of the impeller to a first position wherein a first outlet pipe of the plurality of outlet pipes receives water from the inlet pipe through a slider plate outlet extending through the conical slider plate and a first of a plurality of elongated outlet ports extending through the conical outer plate, the slider plate preventing water from entering at least a second outlet pipe of the plurality of outlet pipes, rotating the conical slider plate responsive to rotation of the impeller to a second position wherein the first outlet pipe receives water from the inlet pipe through the slider plate outlet and the first elongated outlet port and the second outlet pipe receives water from the inlet pipe through the slider plate outlet and a second elongated port of the plurality of elongated outlet ports; and rotating the conical slider plate responsive to rotations of the impeller to a third position wherein the second outlet pipe receives water from the inlet pipe through the slider plate outlet and the second elongated outlet port, the slide plate preventing water from entering the first outlet pipe.

Particular implementations and embodiments may comprise one or more of the following. Adjusting the impeller with an impeller pushrod that extends at least partially outside the pool valve module, the impeller being adjustable between a full speed forward position, a feathered position, and a full speed reverse position. Preventing rotation of the impeller by actuating a pause switch positioned on a cover of the pool valve module. The slider plate may be in the first and third positions for approximately three times longer than the second position. The slider plate is in the first and third positions for approximately 45 seconds and the second position for approximately 15 seconds.

The foregoing and other aspects, features, and advantages will be apparent to those artisans of ordinary skill in the art from the DESCRIPTION and DRAWINGS, and from the CLAIMS.

BRIEF DESCRIPTION OF THE DRAWINGS

The disclosure will hereinafter be described in conjunction with the appended drawings, where like designations denote like elements, and.

DESCRIPTION

This disclosure, its aspects and implementations, are not limited to the specific components or assembly procedures disclosed herein. Many additional components and assembly procedures known in the art consistent with the intended pool valve assembly and/or assembly procedures for a pool valve will become apparent for use with implementations of pool valve assemblies from this disclosure. Accordingly, for example, although particular pool valve assemblies and modules are disclosed, such a pool valve assemblies, modules, and implementing components may comprise any shape, size, style, type, model, version, measurement, concentration, material, quantity, and/or the like as is known in the art for such pool valve assemblies, modules, and implementing components, consistent with the intended operation of a pool valve assembly.

Figure 12:
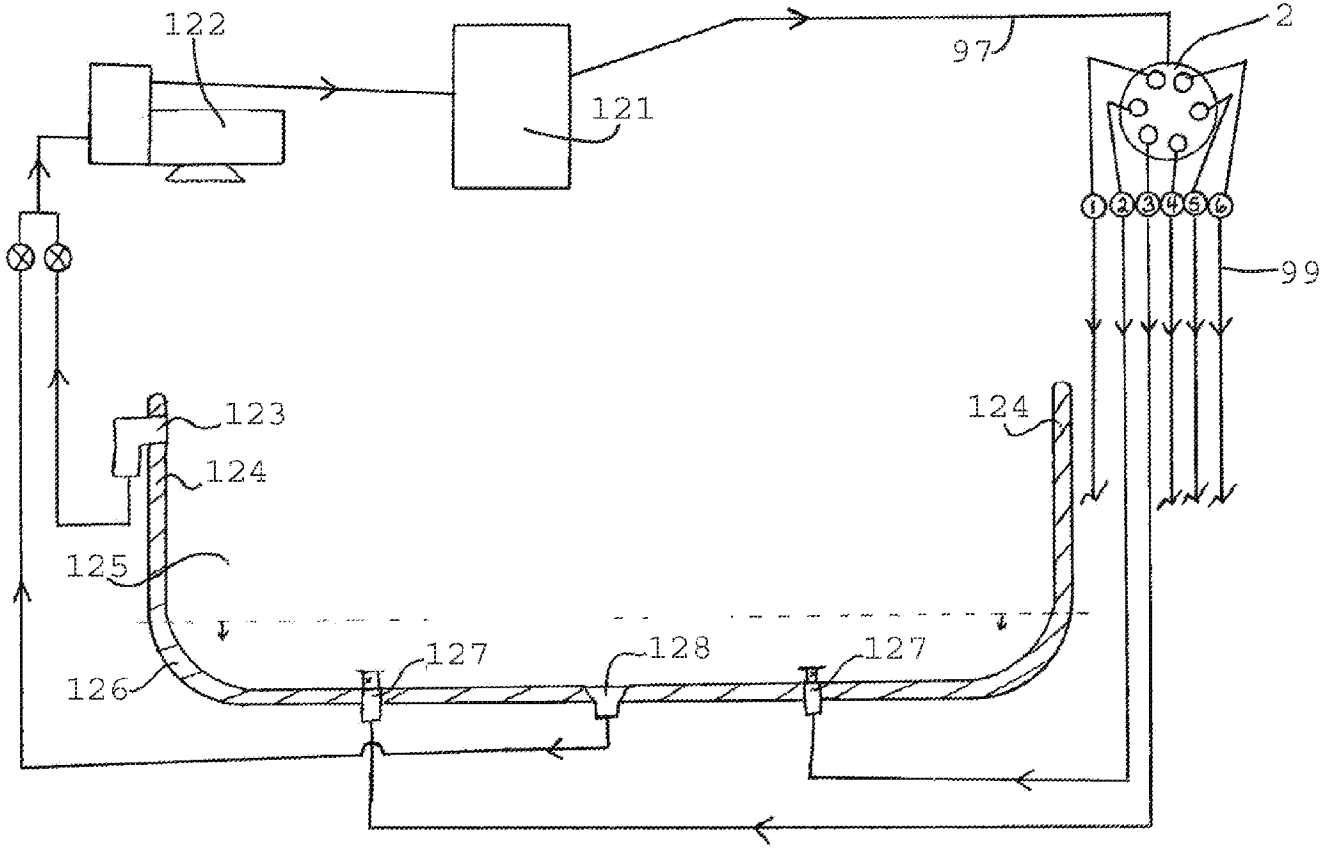
FIG. 12 is a block diagram of a pool cleaning system.

Implementations and embodiments of a water valve assembly described throughout this document may be utilized for a variety of purposes, including but not limited to pools, sprinklers, irrigation, and the like. Although specific descriptions relating to pools are described herein, use in a variety of water flow-related settings is contemplated by the applicants. Implementations disclosed herein are advantageous over prior valve assemblies for a variety of reasons that shall be noted throughout this document. In a particular aspect, an embodiment of the valve assemblies contemplated comprises a modular construction that couples to the pool plumbing. As such, the wear parts of the valve assembly are confined to an easily removable valve module 2, 102 (FIG. 12). This removable valve module 2, 102 allows for convenient, easy, and cost effective service and removal of the valve assembly without disturbing plumbing or other pipes if/when parts of the valve assembly wear out.

In contrast, existing valve assemblies comprise housing coupled directly to the plumbing, including the wear surfaces of the valve assembly. When the wear surfaces of the valve assembly become damaged or wear out, because the wear surfaces are integral with the base, the entire base must be removed and a new base glued to the plumbing. Replacement of the prior valve assemblies is, therefore, costly, difficult, and time consuming.

Figure 4:
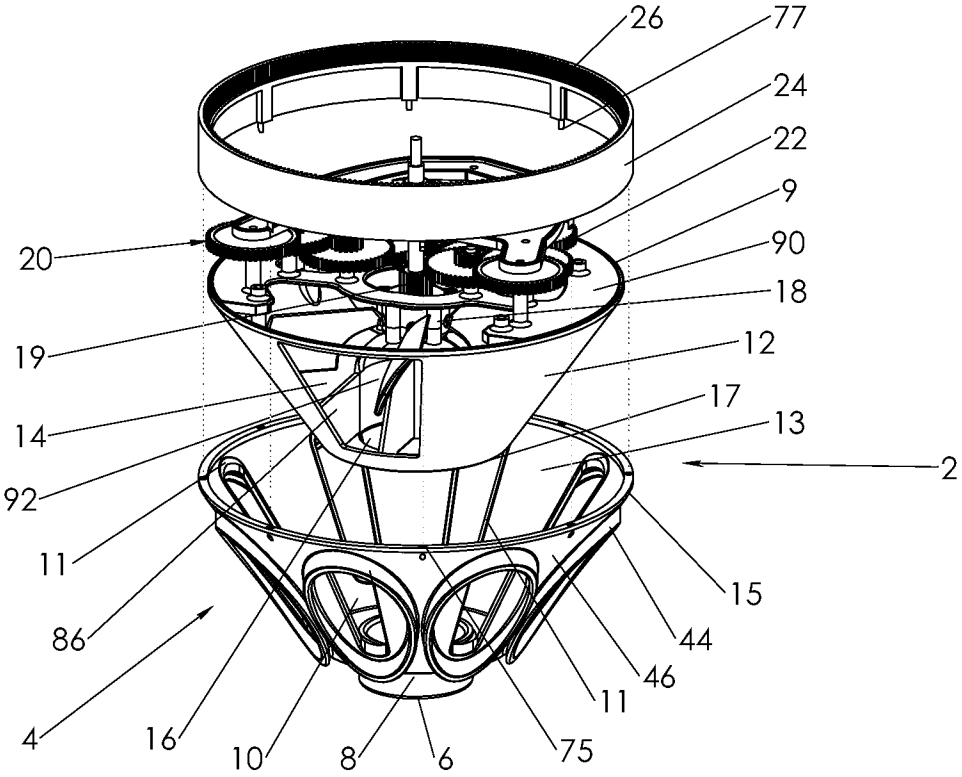
FIG. 4 is an exploded view of an outer plate, slider plate, and ring gear.

Various embodiments of a valve module 2, 102 and method of use may be utilized in a pool cleaning system. FIG. 12 depicts a cross-section of an exemplary pool and block diagram of a particular embodiment of a pool cleaning system. Although FIG. 12 indicates that a particular embodiment of a valve module 2 is included, alternate embodiments of any of the valve modules described herein may be substituted for the particular embodiment of the valve module 2 illustrated in the Figure. In this particular system, the swimming pool 125 comprises one or more cleaning heads 127, at least one drain 128 in the floor 126 of the pool 125, and a skimmer opening 123 on a wall 124 of the pool. Also depicted in FIG. 12 is a swimming pool pump 122, a filter 121, and a valve module 2 (in block diagram form). The swimming pool pump 122 and filter 121 achieves fluid communication with the valve module 2 through pump pipe 97. The valve module 2 achieves fluid communication with the cleaning heads 127 through cleaning pipes 99, shown as individual cleaning pipes 1-6 in FIG. 12. Although six cleaning pipes 99 are depicted as extending from valve module 2, it is contemplated that any number of a cleaning pipes 99 may extend from the valve module 2 and lead to any number of cleaning heads 127. For example, the valve module 2 depicted in FIG. 4 is configured for coupling to eight cleaning pipes 99. Other embodiments may be configured to couple to two, three, four, five, six, seven, eight, nine, ten, eleven, twelve, or more cleaning pipes 99. Moreover, although cleaning heads 127 are referenced, it is also contemplated that the valve module 2 may be coupled to any pool cleaning, playing, or aesthetic device known in the art through cleaning pipes 99.

Figure 14:
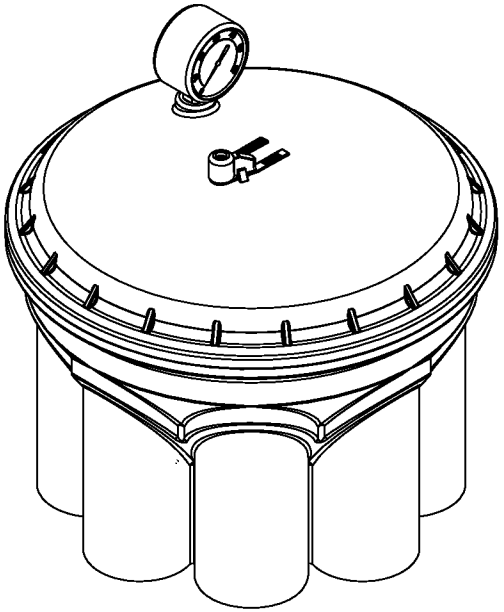
FIG. 14 is a perspective view of a second embodiment of a pool valve assembly.

With reference to FIGS. 1-6, in one or more embodiments a pool valve assembly comprises a valve module 2 comprising an outer plate 4 and a slider plate 12. Though not required in all embodiments, the outer plate 4 typically comprises a conical outer plate 4, and the slider plate 12 typically comprises a conical slider plate 4 sized to rotate and at least partially nest within the conical outer plate 4. In other embodiments, however, the outer plate 4 and slider plate 12 may be substantially planar or cylindrical. Furthermore, although reference is made to a conical shape, it is contemplated that the slider plate 12 and the outer plate 4 typically do not come to a point at their respective narrow ends 18 and 8, but rather comprise a planar portion and/or an opening extending therethrough, as shall be explained in greater detail below, to technically form a subcategory of conical shapes called a frustoconical shape, but which will be referred to herein in its broader category as conical for convenience. Given their conical configuration, both the outer plate 4 and slider plate 12 comprise angled walls. The angle of the outer plate 4 and slider plate 12 may vary according to different embodiments. In one or more embodiments, the angles of the outer plate 4 and slider plate 12 are between approximately 15 and 75 degrees. In more particular embodiments, the angles of the outer plate 4 and slider plate 12 are between 30 and 60 degrees relative to a plane of the narrow end of the respective outer plate 4 or slider plate 12. In a more particular embodiment, the angle is approximately 45 degrees. In another embodiment, the angle is approximately 35 degrees. In still other embodiments, the angle may be between 0 and 90 degrees. According to another aspect, the angle of the outer plate 4 and slider plate 12 is correlated to a diameter of the outlet pipes 40, the number elongated outlet ports 10, the area of each of the elongated outlet ports 10, and the preferred timing of the slider plate opening 14 from one elongated outlet port 10 to the adjacent elongated outlet port 10. For example, in one or more non-limiting embodiments and as depicted in FIG. 14, the angle 140 of the outer plate 4 and slider plate 12 is determined by the angle 140 of the hypotenuse 142 of a right triangle, where the base of the triangle is equal to the diameter 141 of the outlet pipe 40 and the hypotenuse 142 is equal to the length 28 of an elongated outlet port 10. Both the outer plate 4 and slider plate 12 may be hollow or at least partially hollow according to various aspects.

Figure 2:
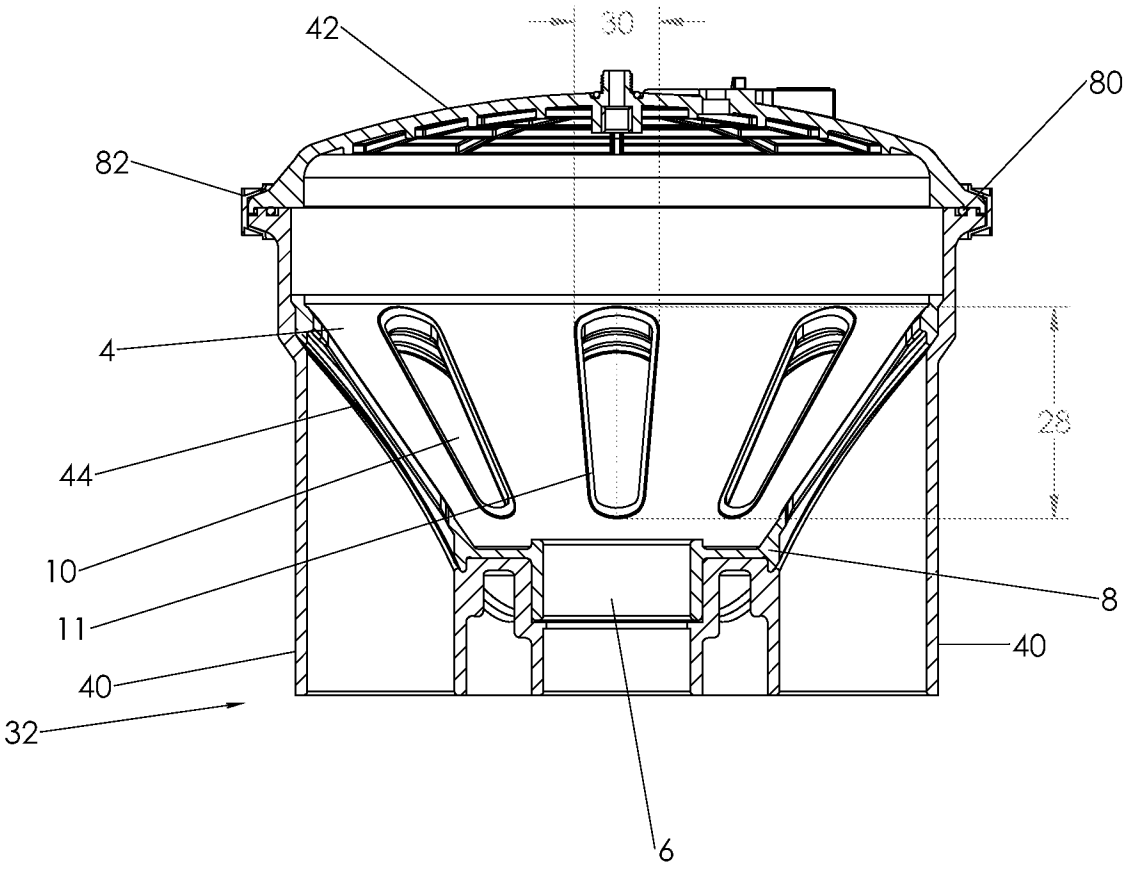
FIG. 2 is a cross sectional view of a outer plate and base of a valve module coupled to two cleaning pipes and a pump pipe taken along sectional line A-A of FIG. 13 with the drive train, impeller, and slider plate removed for clarity.
Figure 3:
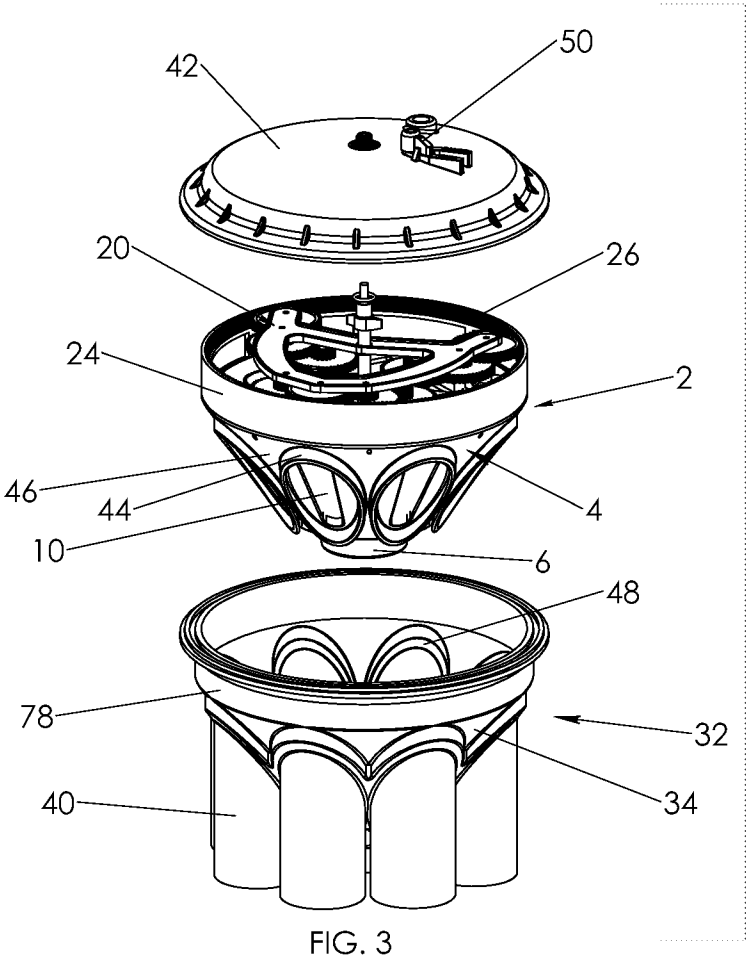
FIG. 3 is an exploded view of a first embodiment of a valve module.

FIGS. 3 and 4 depict two exploded views of a pool valve assembly. In FIG. 3, an exploded perspective view of a base 32, valve module 2, and cover 42 is shown, while in FIG. 4 an exploded perspective view of a ring gear 24, slider plate 12, and outer plate 4 of a valve module 2 is shown. As depicted in the exploded views of FIGS. 3 and 4, various embodiments of an outer plate 4 comprise an inlet port 6 proximate a narrow end 8 of the outer plate 4. A wide end 9 of the outer plate 4 opposite the narrow end 8 is open when the outer plate is removed from the valve module 2, thus allowing for easy insertion and removal of the slider plate 12 within the outer plate 4. In some embodiments, the inlet port 6 comprises a hole extending through a wall of the narrow end 8. In other more particular embodiments, the inlet port 6 comprises a cylindrical passage comprising a cylindrical wall adapted to fit within or around an inlet pipe 36 of a base 32 (FIGS. 5A-5D) or a pump pipe 97 (FIG. 2) of a pool cleaning system. In any event, the inlet port 6 is typically adapted to couple, either removably or fixedly, to any pipe that directs the flow of water into the valve module 2.

As depicted in FIGS. 3 and 4, embodiments of an outer plate 4 comprise a plurality of elongated outlet ports 10. The elongated outlet ports 10 typically comprise an elongated opening extending through the outer plate 4. In the particular embodiment depicted in FIGS. 3 and 4, the outer plate 4 comprises eight elongated outlet ports 10. In other embodiments, the outer plate 4 may comprise more than or fewer than eight elongated outlet ports 10. Typical outer plate 4 embodiments comprise a number of elongated outlet ports 10 equal to the number of outlet pipes 40 in a base 32 (FIGS. 5A-5D) and/or cleaning pipes 99 (FIG. 2) in a pool cleaning system. For example, the embodiment depicted in FIGS. 3 and 4 is configured for use in a pool cleaning system comprising eight outlet pipes 40 in a base 32 and/or eight cleaning pipes 99. In other embodiments, however, the number of cleaning pipes 99 in a pool cleaning system may be less than or greater than the number of elongated outlet ports 10 of an outer plate 4. In a non-limiting embodiment example, a pipe dividing apparatus previously known in the art may be utilized in a pool cleaning system comprise a greater number of cleaning pipes 99 than elongated outlet ports 10.

Figure 13:
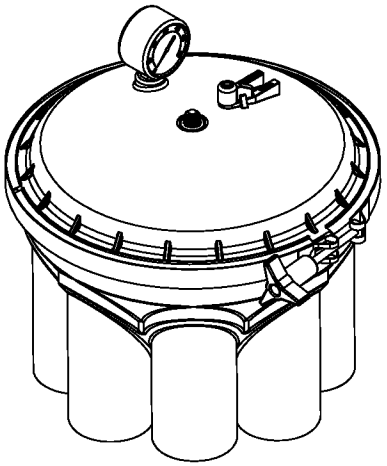
FIG. 13 is a perspective view a first embodiment of a pool valve assembly.

FIG. 2 depicts a cross sectional view of a pool valve assembly taken along sectional line A-A of FIG. 13, but with the ring gear 24, drive train 20, and slider plate 12 removed to expose the elongated outlet ports 10 of the outer plate 4. As demonstrated through the non-limiting example provided in FIG. 2, a length dimension 28 of each elongated outlet port 10 is greater than a width dimension 30 of the same elongated outlet port 10. In particular embodiments, the length dimension 28 is at least two times greater than the width dimension 30 of an elongated outlet port 10. In other embodiments, the ratio of the length dimension 28 and the width dimension 30 may vary according to the specific angle of the outer plate 4 and/or the size of the outlet pipes 40 to which the outlet port 10 is adjacent.

Specifically, the area of elongated outlet port 10 is substantially equal to or slightly greater than a circular area of the inside of the associated outlet pipe 40 in one or more embodiments, the circular area being measured at a point within the outlet pipe 40 wherein the diameter 141 of the outlet pipe 40 is substantially constant (see FIG. 14). In such embodiments, a maximum width 30 of the elongated outlet port 10 is correlated to the preferred amount of time the slider plate 12 exposes only one elongated outlet port 10, while the length 28 of the elongated outlet port 10 is the length necessary, based on the width 30, to achieve an area equal to or slightly greater than the circular area of the inside of the outlet pipe 40. Greater detail on determining the length 28 and width 30 is provided below.

In one or more embodiments, the ratio of the length dimension 28 and the width dimension 30 is correlated to the angle of the outer plate 4. For example, in embodiments comprising an outer plate 4 having a steeper angle, the length dimension 28 may be greater than a length dimension 28 of embodiments comprising a flatter angle. In such embodiments, then, the width dimension 30 may be smaller, resulting in a more elongated outlet port 10. Alternatively, in embodiments comprising an outer plate 4 having a flatter angle, the length dimension 28 of the elongated outlet port 10 is limited. If the area of the elongated outlet port 10 is less than the circular area of the outlet pipe, then potential back pressure or head loss in the valve module 2 is increased.

The size and shape of the elongated outlet ports 10 may vary in differing embodiments. Generally, the shape and area of the elongated outlet ports 10 affects the potential pressure head loss in the valve module 2, the amount of down force between the slider plate 12 and the outer plate 4, and the port-to-port timing (the time required to rotate from full exposure of one elongated outlet port 10 to full exposures of the adjacent elongated outlet port 10) of the valve module 2. Typically, if the open area of the open elongated outlet port 10 approximates the open area of the inlet port 6, any pressure loss through the valve module 2 will be minimal and satisfactory for a swimming pool application. Elongated outlet ports 10 may also narrow from one end of the elongated outlet port 10 to the opposite end of the elongated outlet port 10, or vice versa.

Figure 15:
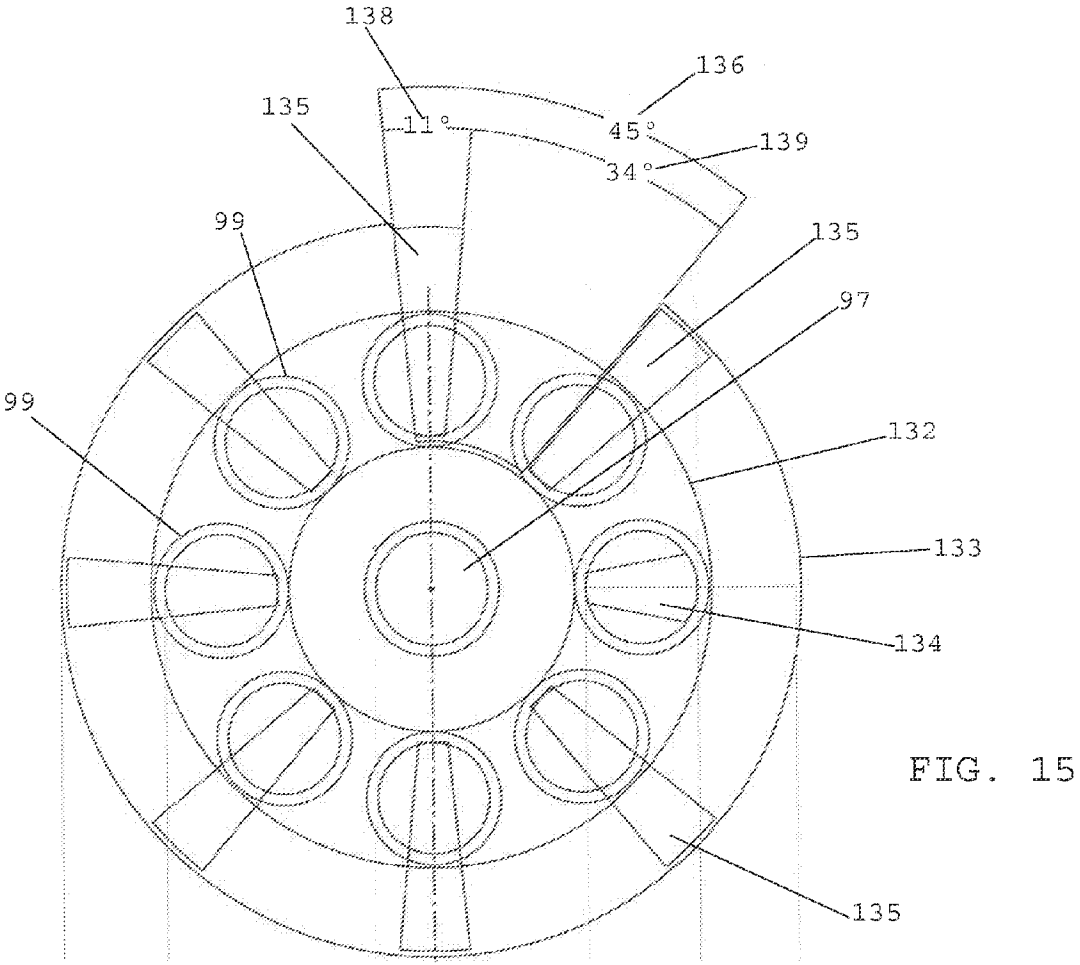
FIG. 15 is a top view of cleaning pipes surrounding an pump pipe without angled ports shown.

In one, non-limiting example, configuration of the valve module 2 is associated with the desired number of elongated outlet ports 10 (or cleaning pipes 99). FIG. 15 depicts a top view of a non-limiting example of eight cleaning pipes 99 symmetrically around an pump pipe 97. FIG. 15 also diagrams how positioning and configurations of the elongated outlet ports 10 of one non-limiting embodiment are determined. In this diagram, circle 132 describes the outer diameter of a valve module comprising angled elongated ports 134 (similar to elongated outlet ports 10), while circle 133 describes the outer diameter of a valve module comprising horizontal elongated outlet ports 135. When compared, it is apparent that if the elongated outlet ports are horizontal, the valve module would be significantly larger (as approximated by circle 133). By angling the elongated outlet ports 134, the valve module size or footprint may be reduced (as approximated by circle 132).

In one or more embodiments, the shape of the elongated outlet ports 10 may be determined as follows. In an embodiment comprising eight elongated outlet ports 10 and outlet pipes 99, symmetrical positioning of the eight elongated outlet ports 10 is determined by the exemplary equation: 360°/8 ports=45° between the center of each elongated outlet port 10. As demonstrated in FIG. 15, 45° is also the positioning from the beginning of one elongated outlet port 135 to the beginning of the adjacent outlet port 135. In FIG. 15, the 45° represents the open area 136 typically desired for slide plate outlet opening 14. That is, the slider plate 12 may comprise a slider plate opening 14 similar to the open area 136 that widens outward at a 45° angle. Such a configuration is advantageous because, as described in relation to FIGS. 5A-5D, full pressure through a single elongated outlet port 10 is maximized.

In one or more embodiments, the elongated outlet ports 10 widen outward. The widening of the elongated outlet ports 10 is determined by the number of elongated outlet ports 10 and the desired full pressure and transition pressure times. By way of non-limiting example, a user may desire a total cycle time of one minute per elongated outlet port, with a full pressure time of 75% (or 45 seconds) and a transition time of 25% (or 15 seconds). Referring now to FIG. 13, the transition degrees 138 is determined by the exemplary calculation of 45°×25%=11°. The full power degrees 139, on the other hand, is determined by the exemplary calculation of 45°−11°=34°. In application to a non-limiting embodiment of the valve module 2, the elongated outlet ports 10 may widen outward at 11°, or a degree similar to the desired transition degrees 138.

Figure 16:
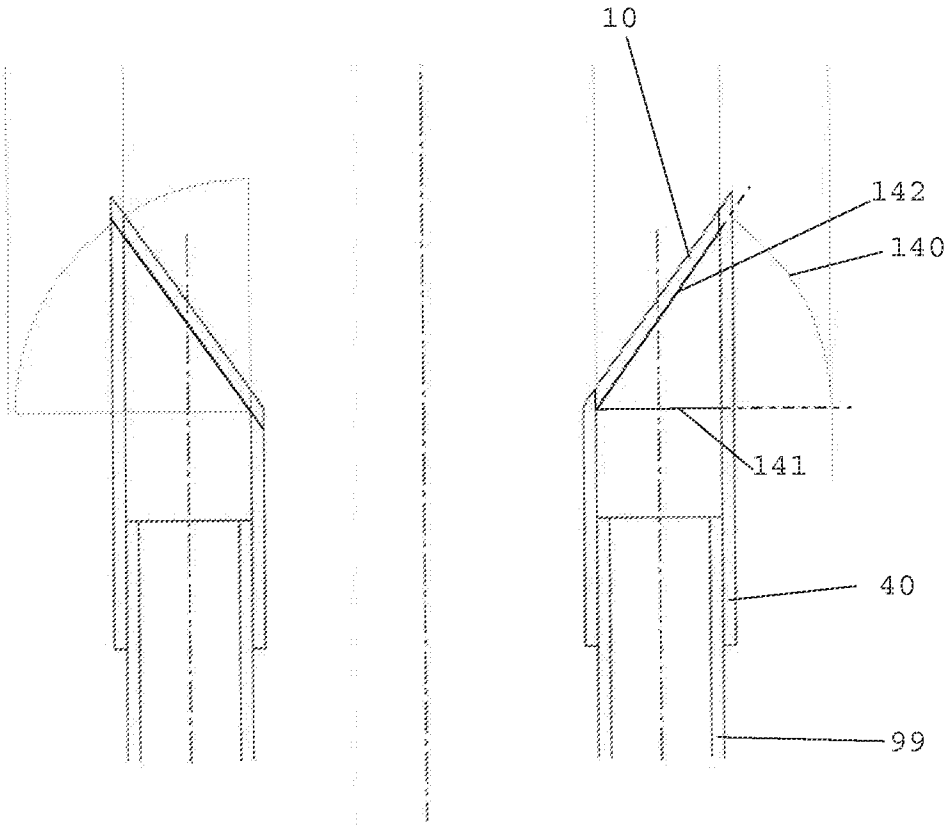
FIG. 16 is a cross-sectional side view of outlet pipes and cleaning pipes of FIG. 15.

Once the desired configuration of the elongated outlet ports 10 is determined by calculating the transition degrees 138, the angle of the slider plate 12 and outer plate 4 may be calculated by determining the angle necessary to transition the horizontal elongated outlet ports 135 to the angle elongated outlet ports 134 diagrammed in FIG. 15. FIG. 16 depicts an exemplary side view diagram of two inlet pipes 99 extending into two outlet pipes 40. The angle of the outer plate 4 is determined by the angle 140 of the hypotenuse 142 of a right triangle. In the right triangle the base is approximately equal to the diameter 141 of the outlet pipe 40 and the length of hypotenuse 142 is approximately equal to the length 28 of the elongated outlet port 10 (shown in FIG. 2). Based on this non-limiting example, it is understood that other embodiments comprising varying cleaning pipes 99, transition times, and angles contemplated as part of this disclosure will become apparent to one of ordinary skill in the art.

One or more embodiments of an outer plate 4 further comprise a plurality of lips 44, or a surrounding ridge, extending from an outer surface 46 of the outer plate 4 around the shape of each of the outlet ports 10. Generally, a different one of the plurality of lips 44 surrounds a different one of the plurality of elongated outlet ports 10. The lips 44 are typically shape, sized, or otherwise configured to complement the lip receivers 48 of a base 32 (FIG. 3). In combination with the lip receivers 48 of the base 32, the lips 44 prevent or at least inhibit water leaking from the assembly when water is flowing through the respective elongated outlet ports 10. In one or more embodiments, the base 32 comprises a face seal comprising an O-ring groove. The lips 44 and lip receivers 48 likewise help prevent or at least inhibit loss of the pressure head of water flowing through the system. The lips 44 of the particular embodiment shown in FIGS. 3 and 4 are typically angled similar to the angle of the outer plate 4 and complementary to an angle of the outlet pipes 40 or cleaning pipes to which the outer plate 4 is adjacent. In other embodiments, however, the lips 44 may extend from the outer plate 4 such that the opening of the lip 44 opposite the elongated outlet port 10 is substantially parallel to the narrow end 8 (FIG. 2) of the outer plate 4.

One or more embodiments of an outer plate 4 further comprise a ridge 11 on an inner surface 13 of the outer plate 4 surrounding each elongated outlet port 10. The ridges 11 are configured to reduce friction between the inner surface 13 of the outer plate 4 and the slider plate 12 when the slider plate 12 rotates within the outer plate 4, and minimize the gap between the slider plate 12 and the outer plate 4 at each outlet port 10 for water flow. In particular embodiments, the ridge 11 comprises a portion of the inner surface 13 surrounding the outlet port 10 being sloped towards the outlet port 10.

Various embodiments of the outer plate 4 comprise a plurality of tab receivers 75 on a rim or wide end 15 of the outer plate 4, the plurality of tab receivers 75 being configured to receive a plurality of tabs 77 extending from the ring gear 24 (FIG. 4). When engaged with one another, the tab receivers 75 and tabs 77 align the slider plate 12 with the outer plate 4, hold the slider plate 12 within the outer plate 4 and prevent undesired rotation of the ring gear 24 and outer plate 4 as the slider plate 12 rotates. In other embodiments, the ring gear 24 and outer plate 4 are fixedly coupled or integral with one another.

As previously referenced, embodiments of a valve module 2 include a slider plate 12 that is slidable or otherwise rotatable within the outer plate 4. FIG. 4 depicts a particular embodiment of a slider plate 12. Like the outer plate 4, the slider plate 12 is typically conical in shape, comprising a narrow end 17 and a wide end 15 opposite the narrow end 17. The slider plate 12 is sized to at least partially nest within a chamber formed by the conical outer plate 4. Furthermore, the slider plate 12 is rotatable within the outer plate 4, as shall be described in greater detail below. Because the slider plate 12 nests within the outer plate 4, the diameters of the narrow end 17 and wide end 15 of the slider plate 12 are typically smaller than the respective diameters of the narrow end 8 and wide end 9 of the outer plate 4. In one or more embodiments, the wide end 15 of the slider plate 12 is below the wide end 9 of the outer plate 4 when the slider plate 12 is nesting within outer plate 4. In other embodiments, the wide end 15 of the slider plate 12 is substantially planar with (as shown in the cross-sectional view of FIG. 1) or above the wide end 9 of the outer plate 4 when the slider plate 12 is nesting within the outer plate 4.

The slider plate 12 comprises a slider plate inlet 16 on a narrow end 17 of the slider plate 12. The slider plate inlet 16 is typically a hole or an opening extending through at least a portion of the narrow end 17 of the slider plate 12. When assembled, the slider plate inlet is adjacent to and in fluid communication with the inlet port 6 of the outer plate 4. In particular embodiments, the slider plate inlet 16 surrounds a raised rim 7 that surrounds the inlet port 6 of the outer plate 4 when slider plate 12 is mounted within the valve module 2.

The slider plate 12 further comprises a slider plate outlet 14 extending therethrough. A width dimension of the slider plate outlet 14 is wider that the width dimension 30 of the elongated outlet port 10, and typically at least two times greater than the width dimension 30 of the elongated outlet port 10. In particular embodiments, a length dimension of the slider plate outlet 14 is substantially equal to a length dimension 28 of the of the elongated outlet ports 10. In other embodiments, the length dimension of the slider plate outlet 14 is greater than the length dimension 28 of the elongated outlet port 10 to mitigate internal friction between the slider plate 12 and the outer plate 4. In most embodiments, the slider plate outlet 14 is sized with a width such that when the slider plate outlet 14 is adjacent a first elongated outlet 10 of the plurality of elongated outlets 10 so that all of the first elongated outlet 10 is exposed, none of the other elongated outlet ports of the plurality of outlet ports 10 are exposed through the slider plate outlet 14. This provides the longest time during which the slider plate outlet 14 is dedicated to only one elongated outlet 10 at a time, and minimizes the time during which the slider plate outlet 14 is split across two adjacent elongated outlets 10. As described above, in a particular, non-limiting example, the slider plate outlet 14 widens outward at an angle substantially equal to the opening angle 136 of the particular embodiment. In a particular, non-limiting embodiment, the slider plate outlet 14 widens at an angle of 45° and the space from the beginning of a first elongated outlet 10 to the beginning of the next adjacent elongated outlet 10 is likewise 45° (see also FIG. 15).

In one or more embodiments, as illustrated in FIGS. 5A-5D and FIG. 6, the slider plate 12 further comprises a support member 88 extending from the slider plate inlet 16 within the chamber formed by the slider plate 12. The support member 88 may comprise a dome shaped body that at least partially covers the slider plate inlet 16. The support member 88 may also comprise a first opening 92 that faces the slider plate outlet 14 and a second opening 93 on a different side of the support member 88 than that of the first opening 92. In particular embodiments, the first 92 and second 93 openings are positioned to direct a first portion of the water flowing into the slider plate inlet 16 to the slider plate outlet 14 through the first opening 92 and a second portion of the water flowing into the slider plate inlet 16 to the impeller through the second opening 93 to rotate the impeller 18.

Various embodiments of a slider plate 12 may further comprise one or more director walls 86 adjacent the first opening 92. The one or more director walls 86 typically extend from the support member 88 to either the slider plate 12 or the slider plate outlet 14. The support member 88 may further comprise a notch or channel sized to receive a tab that extends from the housing 56 of the impeller (FIGS. 7A-7C and FIG. 8). In such embodiments, the support member 88 supports the impeller 18 when a user adjusts the pitch of the blades 52 of the impeller 18 by depressing an impeller adjustment rod 76 (FIGS. 1 and 6) from outside the valve module 2 by accessing the impeller adjustment rod 76 on an outer surface of the valve module 2.

Figure 6:
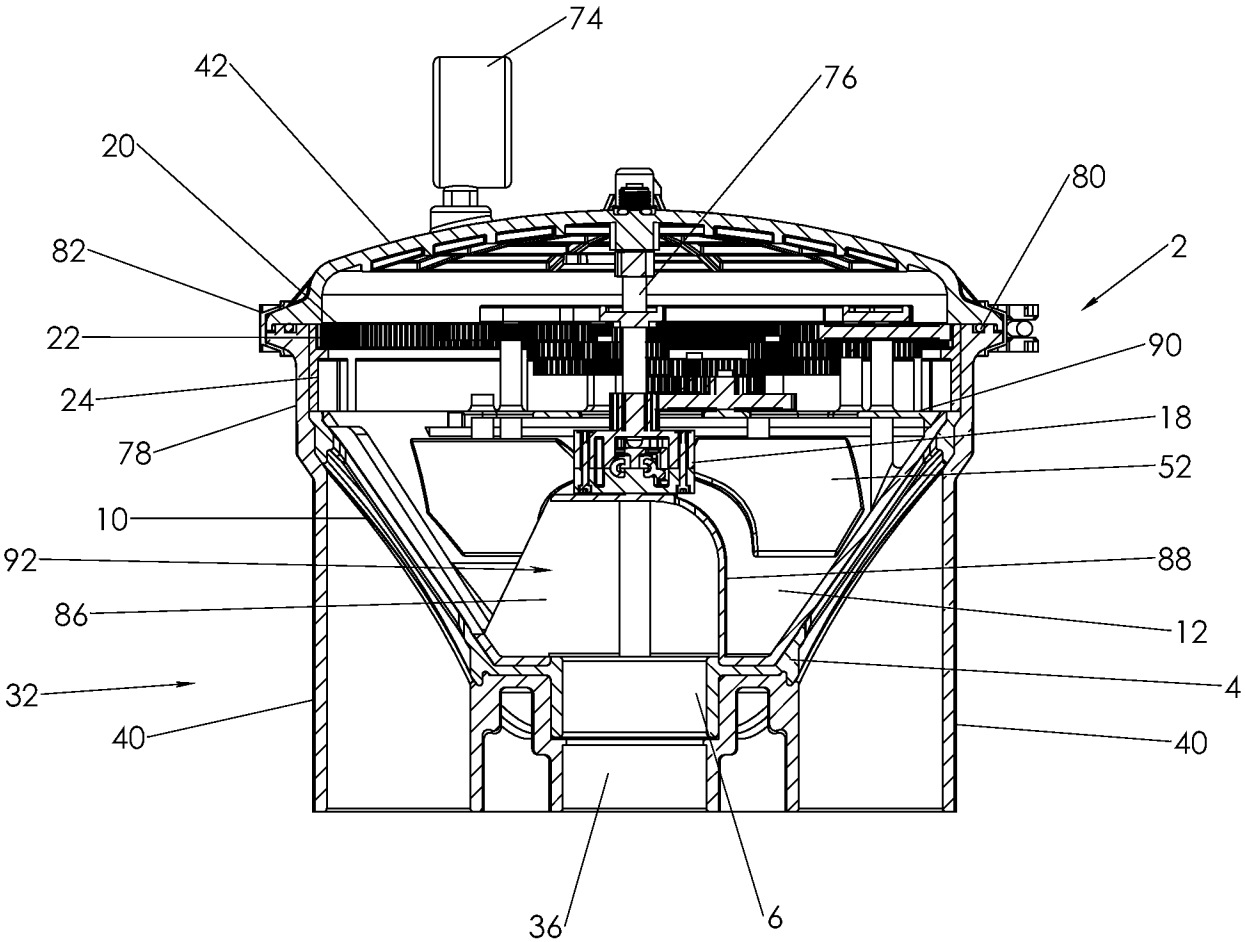
FIG. 6 is a cross sectional view of a first embodiment of a valve module taken along sectional line B-B of FIG. 13.

One or more embodiments of a slider plate 12 further comprise a gear mounting platform 90 extending from the slider plate 12. In the particular embodiment depicted in FIGS. 1 and 4, the gear mounting platform 90 is positioned proximate a wide end 15 of the slider plate 12 (FIGS. 4 and 6). In other embodiments, however, the gear mounting platform 90 is positioned anywhere within or without the slider plate 12.

Figure 9:
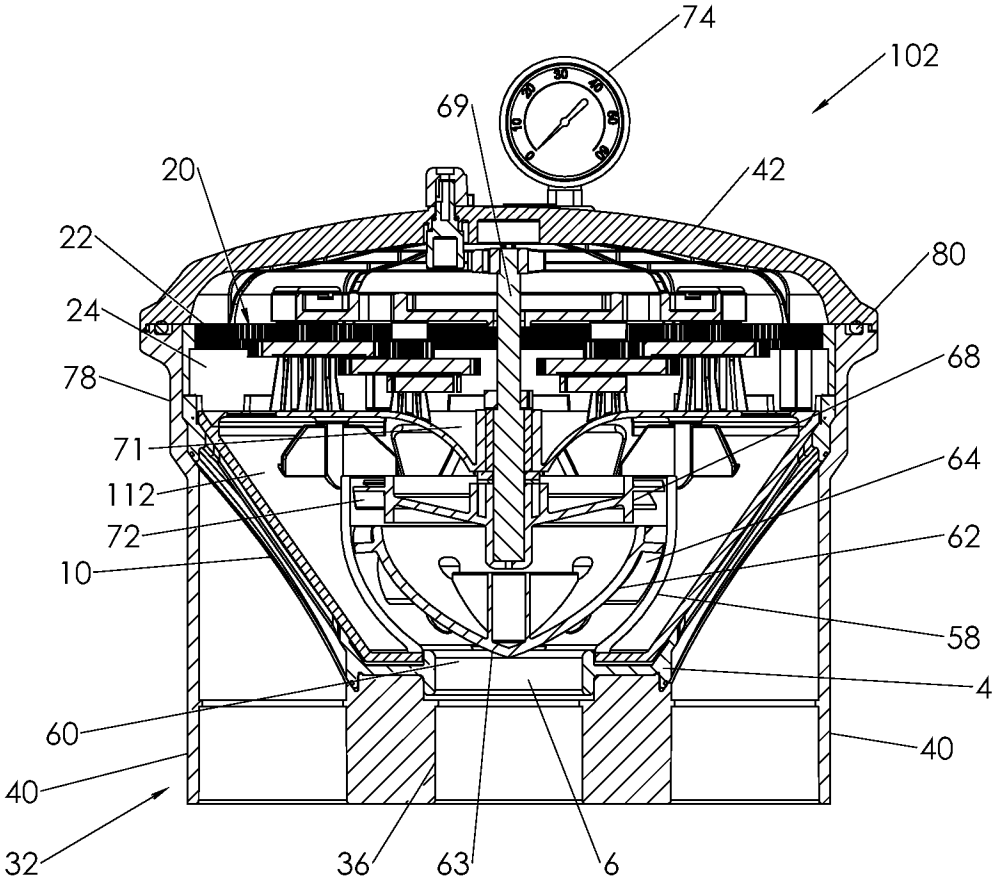
FIG. 9 is a cross sectional view of a second embodiment of a valve module taken along section line C-C of FIG. 14.

One or more embodiments of the valve module 2 further comprise an impeller 18 mounted and rotatable within the chamber formed by the slider plate 12 (FIGS. 4, 6 and 9). According to some aspects, the impeller 18 may comprise any impeller 18 previously known in the art. As previously referenced above, the impeller 18 rotates responsive to water flowing into the slider plate 12 through the inlet port 6 and the slider plate inlet 16, thus introducing a pressure head into the system. The impeller 18 is operably coupled to the slider plate 12, such that rotation of the impeller 18 causes rotation of the slider plate 12 within the outer plate 4.

Figure 1:
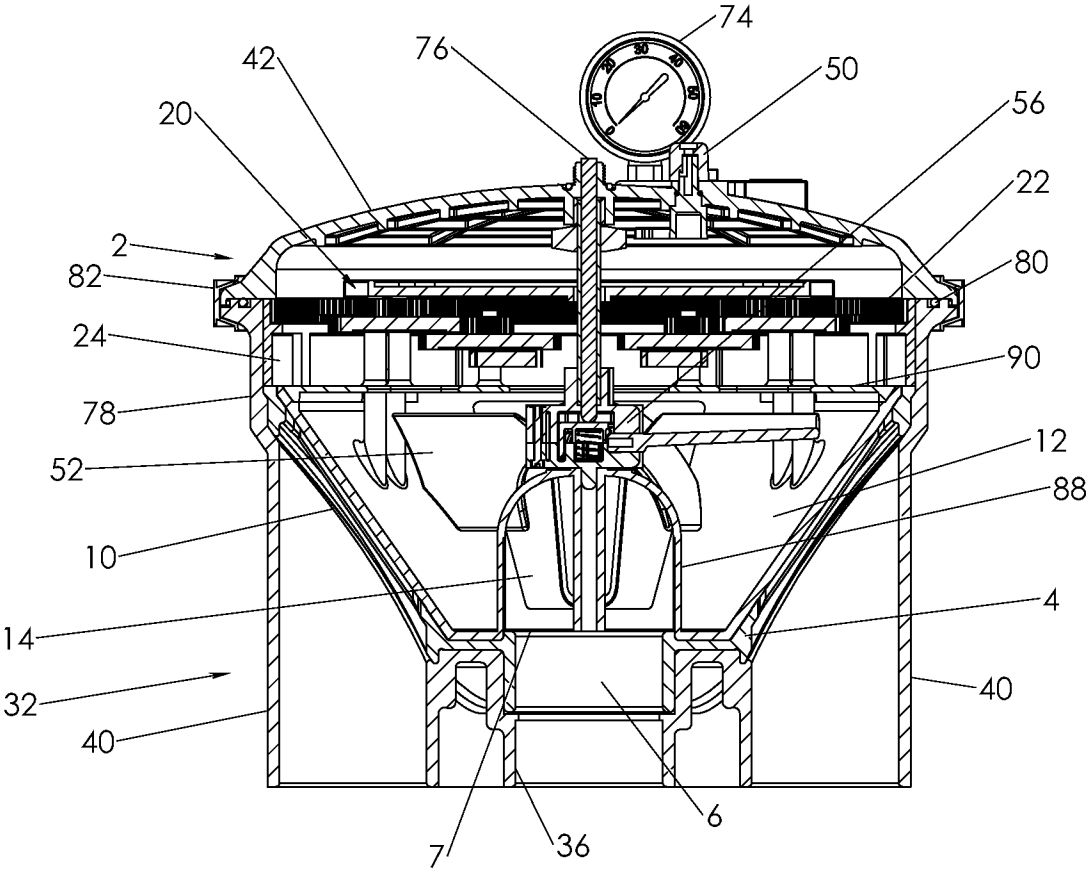
FIG. 1 is a cross sectional view of a first embodiment of a valve module taken along sectional line A-A of FIG. 13.

In the particular embodiment depicted in FIGS. 1 and 4, the impeller 18 is operably coupled to a drive train 20. The drive train 20 is mounted on or otherwise coupled to the gear mounting platform 90 and comprises one or more gears 22. At least one gear of the one more gears 22 is engaged with an impeller gear 19 such that when the impeller 18 rotates the impeller gear 19 also rotates. Rotation of the impeller gear 19 subsequently causes the one or more gears 22 to rotate. Particular embodiments of a valve module 2 further comprise a ring gear 24 removably coupled to the wide end 9 of the outer plate 4. Within the ring gear 24 are positioned a plurality of ridges 26 or teeth configured to engage with at least one of the one or more gears 22 of the drive train 20. Thus, as the one or more gears 22 rotate due to rotation of the impeller 18, the outer plate 4 and ring gear 24 remain stationary while the slider plate 12 rotates within the outer plate 4.

In one or more embodiments, the impeller 18 comprises a variable pitch impeller 18. The variable pitch impeller 18 is configured to change the rate of rotation and/or direction of rotation of the slider plate 12 within the outer plate 4. In particular embodiments, the variable pitch impeller 18 allows a user to change rate or direction of rotation of the slider plate 12 without having to stop and/or dissemble the valve module 2. This configuration allows for fine-tuning of water delivery to the elongated outlet ports 10 without requiring an individual to guess at adjusting a flow-impeding duct to adjust speed. Although shown in use with the valve module 2 described throughout this document, use of the variable pitch impellers disclosed herein with other valve modules or sequencing valves is also contemplated.

Figure 7A:
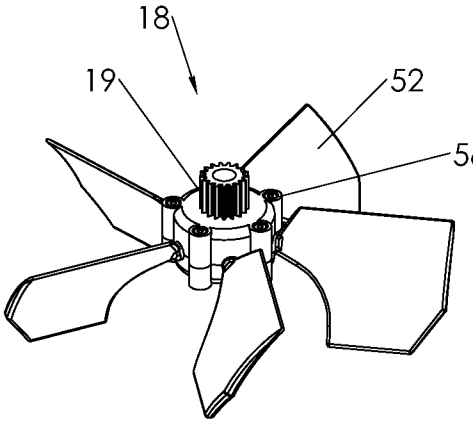
FIGS. 7A-C are perspective views of a variable pitch impeller at three different positions.
Figure 7B:
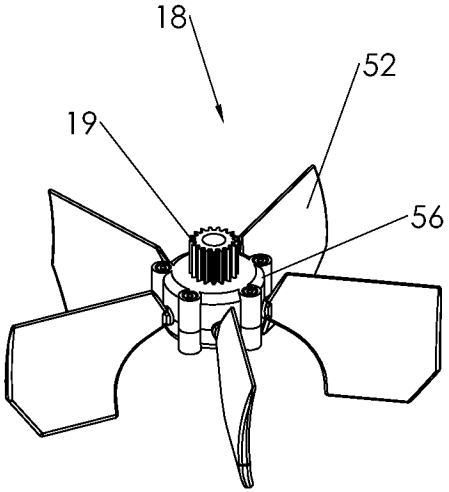
Figure 7C:
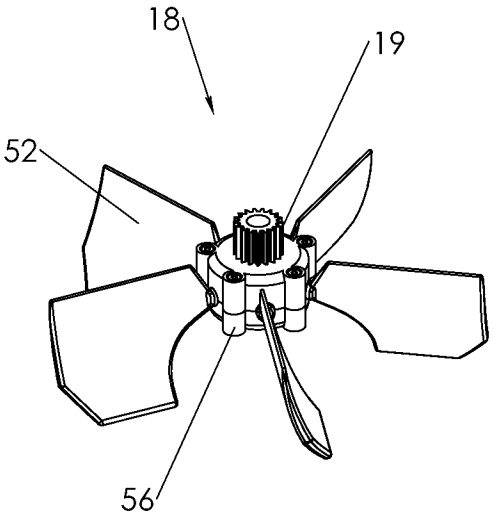

FIGS. 7A-7C depict an embodiment of a variable pitch impeller 18 at three different pitch positions. In FIG. 7A, the impeller blades 52 are depicted in a first or full-speed forward position. In FIG. 7B, the impeller blades 52 are depicted as rotated to a second or feathered position. And in FIG. 7C, the impeller blades are depicted as rotated to a third or full-speed reverse position. Other intermediate positions are also available to adjust the speed of the rotation for the slider plate 12 to a desired speed. By rotating the angle of the impeller blades 52, the effect of water introduced into the system is altered. For example, a pressure head of water applied to the impeller 18 in the full-speed forward position will rotate the impeller 18 at a first speed in a first direction, while the same pressure head of water applied to the impeller 18 in the full-speed reverse position will rotate the impeller 18 at a second speed in a second direction opposite the first direction. Although three positions are shown in FIGS. 7A-7C, such positioning is only exemplary, as the impeller blades may be adjusted to any position between the full-speed forward and full-speed forward as is necessary or desired by the user. Adjusting of the impeller blades adjusts the speed and direction of the impeller rotation.

Figure 8:
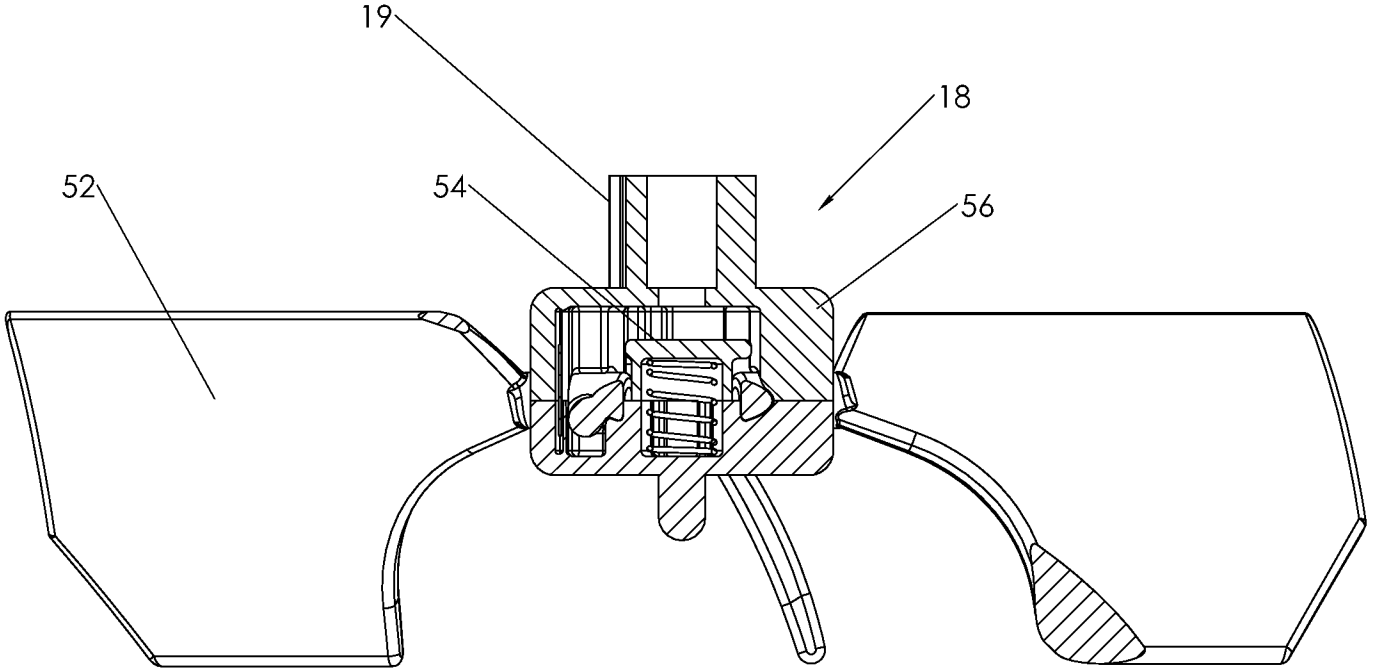
FIG. 8 is a cross sectional view of a variable pitch impeller taken along sectional line D-D of FIG. 7A.

The impeller adjustment rod 76 may be implemented as a screw, pushrod or any of a variety of other tools to adjust the variable pitch impeller 18. FIG. 1 illustrates a rotatable pushrod that extends through the drive train 22 and the cover 42 and down internal to the impeller 18 through an opening at the center of the impeller gear 19 such that the impeller adjustment rod 76 is accessible by a user without dissembling the valve module 2 or even removing the cover 42, and can adjust the angle of the impeller blades 52 and speed of the impeller 18 rotation without dissembling the valve module 2. By twisting the exposed end of the impeller adjustment rod 76, the distal end of the impeller adjustment rod 76 that is coupled to the adjustment mechanisms within the impeller 18, rotates the adjustment mechanisms and the operatively coupled impeller blades 52 to a different angle. FIG. 8 depicts a cross-sectioned view of a particular embodiment of a variable pitch impeller 18 taken along sectional line D-D of FIG. 7A. One or more embodiments of a variable pitch impeller 18 comprise an actuator 54 housed within the impeller housing 56. The impeller blades 52 are pivotally coupled to the housing to allow the rotation of the impeller blades 52 across the rotational spectrum of the full-speed forward position to the full-speed reverse position. The actuator 54 is configured to pivot or otherwise rotate the impeller blades responsive to rotational movement of the impeller adjustment rod 76. One or more embodiments of an actuator 54 may comprise a biasing element, such as a spring, that biases the actuator 54 toward the impeller adjustment rod 76 to maintain their operative engagement when the impeller adjustment rod 76 is inserted into the opening in the impeller gear 19.

According to one aspect, the impeller adjustment rod 76 and actuator 54 is configured so that the actuator 54 incrementally adjusts the impeller blades 52 by one small incremental setting each time the impeller adjustment rod 76 linearly presses against the actuator 54, and then adjusts them back one setting each time the impeller adjustment rod 76 linearly presses against the actuator 54 once an end of the rotational cycle for the impeller blades 52 is reached. In such an embodiment, the impeller blade 52 may alternatively return automatically back to a default position, such as the full-speed forward position, when the impeller blades 52 cannot be pivoted any further in its rotational cycle. According to another aspect, the further the impeller adjustment rod 76 is extended into the impeller housing 56, the more the impeller blades 52 pivot. In such an embodiment, the impeller adjustment rod 76 may comprise a threaded screw that maintains the impeller blades in the desired position by threaded engagement with a portion of the passage leading from the cover to the impeller 18.

With reference back to FIG. 2, in some embodiments the valve module 2 couples directly to the pump pipe 97 and the plurality of cleaning pipes 99. In other embodiments, the valve module 2 is mounted at least partially within a base 32, which base is coupled to the pump pipe 97 and the plurality of cleaning pipes 99. Conventional pool valve assemblies have round outlet ports that are positioned in a horizontal plane and round ports receiving port. Due to cross-over time when the pump output is distributed to two cleaning pipes in conventional systems, there is an inherent reduction in the flow of the individual cleaning pipes. The reduction is so significant that conventional valves only operate at full flow or pressure for a given cleaning pipe approximately 10% of the cycle time for a conventional system. At the remaining 90% of the time, the conventional valve assembly is in some stage of cross-over where flow or pressure is being split between at least two cleaning pipes.

As depicted in FIGS. 1-3, particular embodiments of a valve module 2 may be mounted within or otherwise removably coupled to a base 32. One or more embodiments of a base 32 comprise a conical body 34, an inlet pipe 36, and a plurality of outlet pipes 40. Typically, the inlet pipe 36 extends through a narrow end 38 of the base 32 and is at least partially surrounded by the plurality of outlet pipes 40. The inlet pipe 36 is positioned to align with the inlet port 6 of the outer plate 4 such that the inlet pipe 36 is in fluid communication with the inlet port 6 when the outer plate 4 is mounted at least partially within the base 32 in one or more embodiments. In a specific embodiment, the walls of the inlet port 6 slide at least partially into the inlet pipe 36, as depicted in FIGS. 1 and 2. The inlet pipe 36 is also typically positioned or adapted to couple to the pump pipe 97 such that the inlet pipe 36 is in fluid communication with the pump pipe 97 and receives water pumped from the pump 122.

Embodiments of the base 32 further comprise a plurality of outlet pipes 40. According to one aspect, the plurality of outlet pipes 40 extend from the conical body 34 of the base 32 and may be positioned to at least partially surround the inlet pipe 36. Due to the angled nature of the conical body 34 of the base 32, the openings of the outlet pipes 40 adjacent the conical body 34 are also angled. In one or more embodiments, the base 32 comprises a number of outlet pipes 40 equal to the number of elongated outlet ports 10 of the outer plate 4. For example, in FIG. 3, the base 32 comprises eight outlet ports 40 that align with the eight elongated outlet ports 10 of the outer plate 4. When the outer plate 4 is nested at least partially within the conical body 34 of the base 32, the plurality of elongated outlet ports 10 are aligned with the plurality of outlet pipes 40. In such a configuration, a first outlet pipe of the plurality of outlet pipes 40 is in fluid communication with a first outlet port of the plurality of outlet ports 10, a second outlet pipe of the plurality of outlet pipes 40 is in fluid communication with a second outlet port of the plurality of outlet ports 10, and so on.

Particular embodiments of a base 32 further comprise a plurality of lip receivers 48. In such embodiments, a different lip receiver 48 surrounds a different one of the plurality of outlet pipes 40 on an inner surface of the conical body 34. Each lip receiver 48 is configured to receive a lip 44 surrounding an elongated outlet port 10. The lip receiver 48 may comprise a slot, notch, channel, or any other configuration that allows the lip 44 to seat or rest at least partially within the lip receiver 48.

The base 32 typically comprises a conical or otherwise angled body 34. The conical body 34 is sized to at least partially hold the outer plate 4 therein. Accordingly, the conical body 34 may be configured to complement the shape of the outer plate 4. In one or more embodiments, the base further comprises an annular head 78 on a wide end of the conical body 34 opposite the narrow end. The annular head 78 extends from the conical body 34 and is sized to hold the ring gear 24 and drive train 20 therein. The annular head 78 may further comprise a lip that allows a band clamp 82 (FIG. 1) to removably couple the base 32 to a cover 42.

One or more embodiments of a valve module 2 further comprise a cover 42. The cover 42 may comprise any cover previously known in the art for valve modules or sequencing valves. In the particular embodiment depicted in FIGS. 1-3, the cover 42 is sized to cover the base 32 with the outer plate 4, slider plate 12, drive train 20, impeller 18, and ring gear 24 housed therein. The cover 42 to may be removably coupled to the base 32 with a band clamp 82 or any other coupling device known in the art. In particular embodiments, a sealing ring 80 is positioned between the cover 42 and the base 32 to enhance the sealing capacity of the clamp 82.

As depicted in FIGS. 1-3, some embodiments of a cover 42 comprise an activation switch 50. The activation switch 50 is configured to move from a run position and a pause position. The activation switch 50 is operably coupled to the drive train 20 and/or impeller 18 such that when the activation switch 50 is in the run position, the impeller 18 and the gears 22 of the drive train 20 are free to rotate, thus rotating the slider plate 12. The activation switch 50 is further operably coupled to the drive train 20 and/or impeller such that when the activation switch is in the pause position, at least one of the impeller 18 and/or gears 22 of the drive train 20 are prevented from rotating, thus preventing rotation of the slider plate 12. Particular embodiments of a cover 42 further comprise a pressure gauge 74 coupled thereto and configured to measure and display the pressure within the valve module 2.

When viewed as a whole, various aspects of the various embodiments of a valve module 2 provide significant advantages over conventional valve modules. As described throughout this document, a valve base 32, outer plate 4, and slider plate may each comprise angled walls from a horizontal plane, such as in a conical configuration. This configuration allows for interaction between elongated outlet ports 10 and outlet pipes 40, and between a slider plate outlet 14 and elongated outlet ports 10 within a smaller footprint or overall area. In other words, the angled or conical nature of the components of a valve module 2 with that configuration reduces the overall diameter of the valve module 2 relative to other valve modules.

This angled configuration of aspect of a valve module 2 also improves efficiency of the valve module in a pool cleaning system. As previously described, the outlet ports 10 of the outer plate 4 may be elongated in shape. When used in cooperation with an appropriately configured slider plate 12 and slider plate outlet 14 extending therethrough, the amount of time that the slider plate outlet 14 overlaps two (rather than one) elongated outlet port 10 is significantly decreased. This, in turn, provides a full power of water supply to each outlet pipe 40 and ultimately each cleaning head 127 for a greater period of time than a conventional valve module. It is advantageous that the fluid flow (head loss) be kept low.

FIGS. 5A-5D depict four stages of sequential rotation of the slider plate 12 that demonstrate the improved efficiency of thusly configured valve modules 2, allowing for improved sequential distribution of water to a plurality of cleaning valves. In FIGS. 5A-5D the cover 42, impeller 18, and drive train 20 are removed to allow illustration of the slider plate 12 in various positions. In such an embodiment, water enters the valve module 2 through the first 92 (FIG. 4) and the second 93 openings of the slider plate 12. Water entering the valve module 2 through the second opening 93 may assist in rotation of the impeller 18, while water entering the valve module 2 through the first opening 92 may be more directly flowing to the slider plate outlet 14. In other embodiments, however only the slide plate inlet 16 (FIG. 4) is required.

Figure 5B:
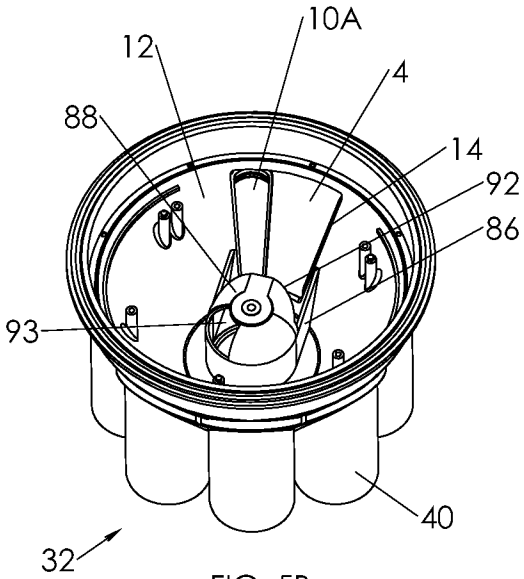
FIGS. 5A-D are perspective views of a portion of a first embodiment of a valve module shown stages of rotation of the slider plate.
Figure 5A:
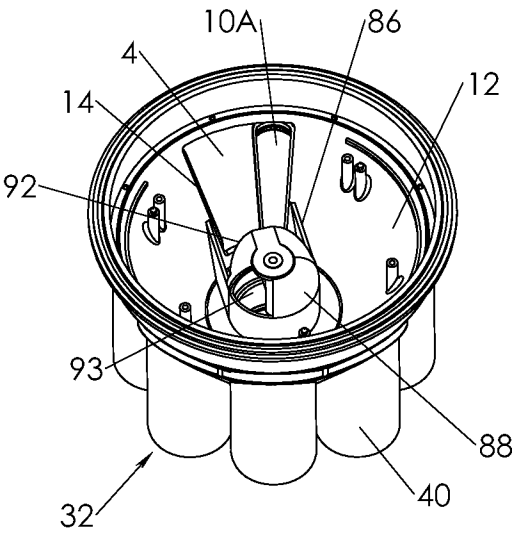

In FIG. 5A, the slider plate 12 is positioned such that the slider plate 12 is not covering any of a first elongated outlet port 10A of the plurality of outlet ports 10 while simultaneously covering the remaining elongated outlet ports 10, including a second outlet port 10B of the plurality of elongated outlet ports. As such, the first elongated outlet port 10A is in fluid communication with the inlet pipe 36, while the second outlet port 10B and remaining plurality of outlet ports 10 are not in fluid communication with the inlet pipe 6. Therefore, a full pressure head of water is directed into the outlet pipe 40 aligned with the first elongated outlet port 10A because water is not being diverted to any other outlet pipes 40 through the second elongated outlet port 10B or the other remaining elongated outlet ports 10.

As water continues to flow into the valve module 2, the rotation of the impeller 18 continuously rotates the slider plate 12 in a clockwise direction (in the exemplary embodiment) to a position shown in FIG. 5B. As depicted, the first elongated outlet port 10A is still entirely or mostly uncovered by the slider plate 12 in FIG. 5B, allowing the fluid communication through the first elongated outlet port 10A to continue. In particular embodiments, as the slider plate 12 begins to partially cover the first elongated outlet port 10A, the slider plate 12 simultaneously begins to partially uncover the second elongated outlet port 10B. In this way, the cross-sectional area of the uncovered openings of the combined plurality of outlet ports 10 remains substantially the same, the amount being covered by the slider plate 12 rotation on a first elongated outlet port 10A being substantially the same as the amount simultaneously being uncovered by the slider plate 12 rotation for a second elongated outlet port 10B. The elongated shape of the outlet ports 10, enhanced by the angled configuration of the outer plate 4, allow a full pressure head of water to flow into any on single port before the slider plate 12 rotates sufficient to allow a portion of water to flow into an adjacent outlet port 10.

Figure 5D:
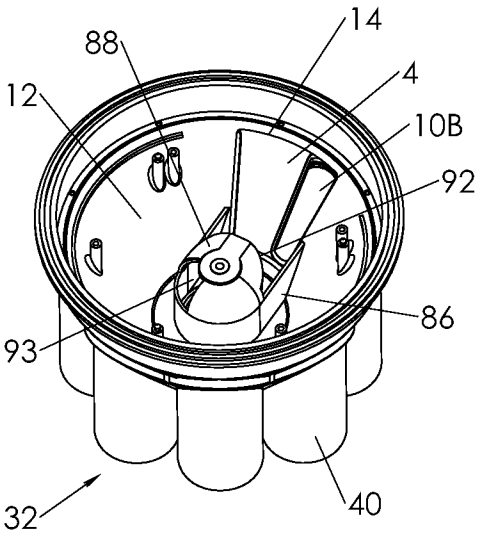
Figure 5C:
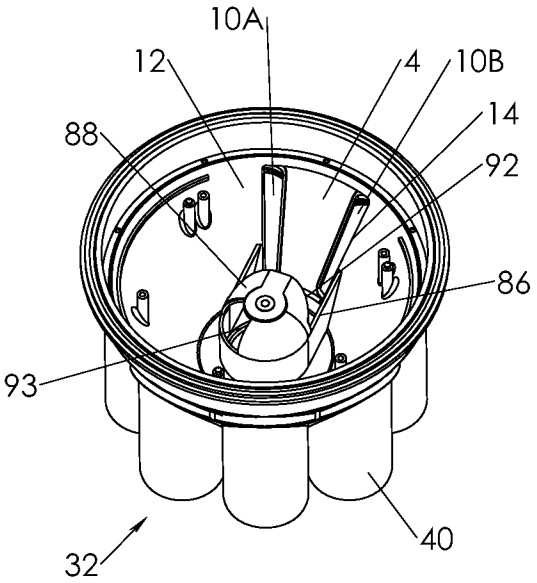

FIG. 5C depicts the slider plate 12 in a second position wherein both the first 10A and second 10B elongated ports are open or uncovered by the slider plate 12. In this particular embodiment, the remaining six outlet ports remain covered by the slider plate 12 in this position. Therefore, at least a portion of both the first 10A and second 10B elongated outlet ports are in fluid communication with the inlet pipe 36 in the second position depicted in FIG. 5C, while none of the remaining plurality of elongated outlet ports 10 are in fluid communication with the inlet pipe 6. In such a position, less than a full pressure is passed each of the first 10A and second 10B elongated outlet ports because the pressure is divided between the two elongated outlet ports 10A, 10B. This in turn, results in lower efficiency of cleaning heads 127 associated with each of the elongated outlet ports 10A, 10B. Because the elongated outlet ports 10 are narrow and tall, respectively, this overlap time is minimized relative to conventional valve assemblies known in the art in which the overlap time sometimes constitutes 90% of the total flow time.

As the slider plate 12 rotates to completely cover the first elongated outlet port 10A, the second elongated outlet port 10B is completely uncovered, as shown in FIG. 5D. In this third position, only the second elongated outlet port 10B is completely uncovered and the remaining plurality of elongated outlet ports 10 are covered, meaning a full pressure head is passed through elongated outlet port 10B. Moreover, in this position, the second elongated outlet port 10B is in fluid communication with the inlet pipe 36, while the first elongated outlet port 10A and the remaining plurality of elongated outlet ports 10 are not in fluid communication with the same inlet pipe 36.

A full pressure head of water passing through each elongated outlet port 10 to cleaning head 127 or other device is advantageous and desirable. In particular embodiments disclosed herein, the amount or percentage of time with a full pressure head flowing through each elongated outlet port 10 is maximized. In particular embodiments, the amount of time each elongated outlet port 10 receives a full pressure head is approximately three times greater than the amount of time each elongated outlet port 10 receives less than a full pressure head of water. More particularly, in one embodiment, the cycle time from elongated outlet port 10 to adjacent outlet port 10 is approximately one minute. In such embodiments, the transition time between elongated outlet ports 10 wherein the ports receive less than a full pressure head of water does not exceed approximately fifteen seconds, while the time each elongated outlet port 10 receives a full pressure head is approximately forty-five seconds.

FIGS. 9-11 and 14 depict another embodiment of a valve module 102. Specifically, FIG. 9 is a cross sectional view of a valve module 102 taken along sectional line C-C of FIG. 14. Aspects of a valve module 102 may be combined with aspects of the valve module 2 previously described herein. Unless otherwise specified or referenced, one or more embodiments of the valve module 102 utilize aspects similar to the valve module previously described, such as but not limited to the base 32, outer plate 4, cover 42, and/or drive train 20. The various aspects described with respect to the previous valve module 2 may also be implemented in this other embodiment, and the new aspects of this other embodiment of a valve module 102 may be implemented in conjunction with previous embodiments described.

Figure 10:
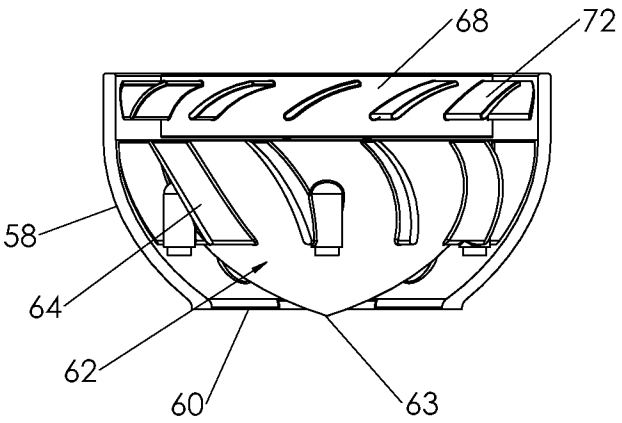
FIG. 10 is a side view of a shroud with a pre-swirler and impeller positioned therein with a portion of the shroud removed to expose the pre-swirler and impeller.
Figure 11:
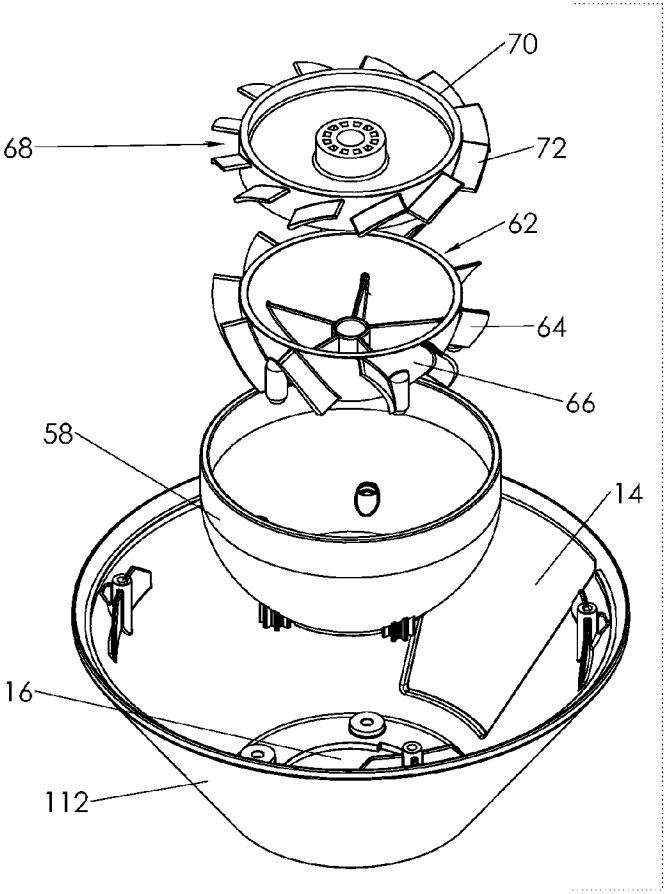
FIG. 11 is an exploded view of a slider plate, shroud, pre-swirler, and impeller.

FIG. 11 depicts an exploded perspective view of a slider plate 112, shroud 58, pre-swirler 66, and impeller 68. As depicted in FIG. 11, an embodiment of a valve module 102 comprises a slider plate 112 similar to embodiments of a slider plate 12 previously described herein. The embodiment of a slider plate 112 depicted in FIGS. 9-11 and 14, however, does not include the support member 88 and director walls 86. The slider plate 112, however, comprises a slider plate inlet 16 and slider plate outlet 14 similar to the slider plate 12 previously described, and is configured to rotate within the outer plate 4 responsive to rotation of the drive train 20.

Coupled to the slider plate 112 within the conical body of the slider plate 112 of one more embodiments is a shroud 58. The shroud 58 in this embodiment is bowl shaped and configured to mount to the slider plate 112 adjacent to the slider plate inlet 16. The shroud 58 comprises a shroud opening 60 adjacent to and in fluid communication with the slider plate inlet 16 and is mounted within the slider plate 112. The shroud is configured such that, upon reception of a pressure head of water, the shroud 58 increases the velocity of the flow through the valve module 102.

FIG. 10 depicts an embodiment of a shroud 58 with a pre-swirler 62 as in FIG. 11, and an impeller 68 mounted therein. In FIG. 10, a portion of the shroud 58 is removed to expose the pre-swirler 62 and impeller 68. Mounted at least partially within a shroud 58 in one more embodiments is a pre-swirler 62. The pre-swirler 62 may comprise any device configured to direct the flow of water into an impeller 68 to improve or otherwise create a maximum torque. In a particular embodiment, the pre-swirler 62 is substantially bowl-shaped with a pointed base 63. When mounted within the shroud 58, the pointed base 63 extends beyond a plane of the shroud opening 60 and, in some embodiments, through the slider plate inlet 16 and at least partially into the inlet port 6. In other embodiments, the pointed base 63 of the pre-swirler 62 is planar with the shroud opening 60 or above the shroud opening 60 when the pre-swirler 62 is mounted within the shroud 58. In particular embodiment, the pre-swirler 62 may comprise one or more supports or tabs configured to align and mount the pre-swirler 62 within the shroud 58.

One or more embodiments of a pre-swirler 62 further comprise one or more blades 64 extending from an outer surface 66 of the pre-swirler 62. In a particular embodiment, the blades 64 of the pre-swirler 62 are arced or angled such that the flow of water through the shroud 58 is likewise arced or re-directed in a direction substantially perpendicular to at least a portion of the blades 72 of the impeller 68. This is advantageous because the result is more efficient rotation of the impeller 68 with the same amount of water flow.

One or more embodiments of a valve module 102 further comprises an impeller 68 rotatably mounted at least partially within the shroud 58. Typically, a pre-swirler 62 is positioned within the shroud 58 between the impeller 68 and the pointed base 63 of the shroud 58. In a particular embodiment, the impeller 68 comprises a circular or cylindrical body 70 and one or more impeller blades 72 extending outward from the body 70 of the impeller 68. The impeller blades 72 are typically angled and/or arced such that the force or pressure of water flowing into the shroud 58 rotates the impeller 68. As previously described, the valve module 102 may comprise a pre-swirler that directs the flow of water more perpendicularly to the positioning of the impeller blades 72 to rotate the impeller 68 more efficiently.

Similar to the valve module 2, the rotation of the impeller 68 rotates the one or more gears 22 of the drive train 20, which in turn rotates the slider plate 112 within the outer plate 4. In a particular embodiment, the valve module 102 comprises a rod 69 (FIG. 9) centrally coupled to the impeller 68 such that the rod 69 rotates responsive to rotation of the impeller 68. More particularly, the rod 69 may be pressed or molded to the impeller 68. The rod 69 further comprises a drive gear on the rod 29 that is configured to engage with at least one gear 22 of the drive train 20 such that rotation of the rod 69 rotates the at least one gear 22 of the drive train 20, thus rotating the slider plate 112 within the outer plate 4.

One or more embodiments of a valve module 102 further comprise a gear mounting platform 71. The gear mounting platform 71 is typically coupled to or mounted at least partially within the slider plate 112 and is configured to hold and support the drive train 20. Typically, the drive train 20 is coupled to the gear mounting platform 71 such that the drive train 20 rotates simultaneous to rotation of the gear mounting platform 71. The gear mounting platform 71 may further comprise a funnel-like center portion with the rod 69 extending therethrough.

It will be understood that implementations are not limited to the specific components disclosed herein, as virtually any components consistent with the intended operation of a method and/or system implementation for valve assemblies may be utilized. Accordingly, for example, although particular valve assemblies may be disclosed, such components may comprise any shape, size, style, type, model, version, class, grade, measurement, concentration, material, weight, quantity, and/or the like consistent with the intended operation of a method and/or system implementation for a valve assembly may be used.

In places where the description above refers to particular implementations of a valve assembly or module, it should be readily apparent that a number of modifications may be made without departing from the spirit thereof and that these implementations may be applied to other valve assemblies and modules. The accompanying claims are intended to cover such modifications as would fall within the true spirit and scope of the disclosure set forth in this document. The presently disclosed implementations are, therefore, to be considered in all respects as illustrative and not restrictive, the scope of the disclosure being indicated by the appended claims rather than the foregoing description. All changes that come within the meaning of and range of equivalency of the claims are intended to be embraced therein.

The invention claimed is:

1. A pool valve assembly, comprising:

a valve module comprising:

a conical outer plate comprising an inlet port proximate a narrow end of the conical outer plate, and a plurality of elongated outlet ports each extending through a surface plane of the outer plate and having a width dimension measured in the surface plane of the outer plate smaller than its length dimension measured in the surface plane of the outer plate;

a conical slider plate rotatably positioned within the outer plate and comprising a slider plate outlet extending through the slider plate and a slider plate inlet proximate a narrow end of the conical slider plate, the slider plate inlet positioned adjacent to the inlet port of the outer plate such that the slider plate inlet and the outer plate inlet are in fluid communication; and an impeller rotatably coupled to the slider plate, the impeller rotatably responsive to water flowing into the slider plate inlet to rotate the slider plate from a first position that allows fluid communication between a first elongated outlet port of the plurality of elongated outlet ports and the slider plate outlet but prevents fluid communication between at least a second elongated outlet port of the plurality of elongated outlet port and the slider plate outlet, to a second position that allows fluid communication between the first and second elongated outlet ports and the slider plate outlet, and to at least a third position that allows fluid communication between the second elongated outlet port and the slider plate outlet but prevents fluid communication between the first elongated outlet port and the slider plate outlet.

2. The pool valve assembly of claim 1, wherein the pool valve module further comprises:

an impeller gear coupled to the impeller;

a drive train coupled to the slider plate and comprising one or more gears, the one or more gears engaged with the impeller gear and rotatable responsive to rotation of the impeller; and a ring gear coupled to the outer plate and comprising a plurality of ridges that engage with the one or more gears of the drive train as the impeller rotates the one or more gears of the drive train, the ring gear rotating the slider plate responsive to rotation of the one or more gears engaged with the plurality of ridges of the ring gear.

3. The pool valve assembly of claim 2, wherein:

the length dimension of each of the plurality of elongated outlet ports is at least two times greater than the width dimension of each of the plurality of elongated outlet ports; and the slider plate is in each of the first and third positions approximately three times longer than the second position when the impeller rotates at a substantially constant rate.

4. The pool valve assembly of claim 3, further comprising a base removably coupled to the outer plate and a cover removably coupled to at least one of the base and the ring gear, the base comprising:

a conical body sized to allow the outer plate to nest at least partially within the conical body;

an inlet pipe positioned proximate a narrow end of the conical body and aligned with the inlet port of the outer plate to allow fluid communication between the inlet pipe and the inlet port; and a plurality of outlet pipes equal in number to the plurality elongated outlet ports and aligned with the plurality of outlet pipes, each outlet pipe being in fluid communication with a different elongated outlet port of the plurality of outlet ports, wherein each outlet pipe comprises a circular area equal to or less than an area of the elongated outlet port to which it is aligned.

5. The pool valve assembly of claim 4, further comprising:

a plurality of lips, each one of the plurality of lips extending from an outer surface of the outer plate and at least partially surrounding a different one of the plurality of elongated outlet ports; and a plurality of lip receivers, each one of the plurality of lip receivers positioned between the conical body and a different one of the outlet pipes of the base and shaped to receive a different one of the plurality of lips.

6. The pool valve assembly of claim 5, further comprising an activation switch positioned on an exterior surface of the cover and operably coupled to the impeller to prevent rotation of the impeller when the switch is in a pause position.

7. The pool valve assembly of claim 6, wherein the impeller comprises a variable pitch impeller comprising a plurality of impeller blades each adjustable between a full speed forward position, a feathered position, and a full speed reverse position responsive to actuation of an actuator positioned within a housing of the impeller by a pushrod extending outside the valve module.

8. The pool valve assembly of claim 6, further comprising:

a bowl-shaped shroud positioned at least partially within the slider plate and coupled to the narrow end of the slider plate, the shroud comprising a shroud opening in fluid communication with the slider plate inlet, the shroud increasing a velocity of water flow into the impeller responsive to water flowing through the slider plate inlet and the shroud opening; and a pre-swirler apparatus mounted at least partially within the shroud, the pre-swirler comprising one or more pre-swirler blades extending from an outer surface of the pre-swirler, the pre-swirling blades directing water flow into the impeller responsive to water flowing through the slider plate inlet and the shroud opening.

9. The pool valve assembly of claim 1, further comprising a base comprising a conical body at least partially surrounding the conical outer plate, and a plurality of outlet pipes each in fluid communication with a different one of the elongated outlet ports.

10. The pool valve assembly of claim 9, further comprising a pump in fluid communication with the inlet port.

11. A pool valve assembly, comprising:

a base comprising a conical body, an inlet pipe positioned proximate a narrow end of the conical body, and a plurality of outlet pipes; and a pool valve module comprising:

a conical outer plate positioned at least partially within the conical body of the base and comprising a plurality of elongated outlet ports each extending through the outer plate and in fluid communication with a different one of the plurality of outlet pipes and the inlet pipe, each one of the plurality of elongated outlet ports comprising an area greater than or substantially equal to a circular area of the outlet pipe with which it is in fluid communication;

a conical slider plate rotatably positioned within the outer plate and comprising a slider plate outlet extending through the slider plate and a slider plate inlet proximate a narrow end of the slider plate, the slider plate inlet positioned adjacent to the inlet port such that the slider plate outlet is in fluid communication with the inlet port through the slider plate inlet; and an impeller rotatably coupled to the slider plate and rotatably responsive to water flow from a pump entering the valve module through the inlet port to rotate the slide plate within the outer plate from a first position to a second position.

12. The pool valve assembly of claim 11, wherein the pool valve module further comprises:

an impeller gear coupled to the impeller;

a drive train coupled to the slider plate and comprising one or more gears engaged with the impeller gear such that the one or more gears rotate responsive to rotation of the impeller;

a ring gear coupled to the outer plate and comprising a plurality of ridges that engage with the one or more gears of the gear train as the impeller rotates the one or more gears of the drive train, the ring gear rotating the slider plate responsive to rotation of the one or more gears engaged with the plurality of ridges of the ring gear; and a cover removably coupled to at least one of the base and the ring gear.

13. The pool valve assembly of claim 12, wherein:

a length dimension of each of the plurality of elongated outlet ports is at least two times greater than a width dimension of each of the plurality of elongated outlet ports; and the slider plate is in each of the first and third positions approximately three times longer than the first position when the impeller rotates responsive to water flow from the pump entering the valve module through the valve port.

14. The pool valve assembly of claim 13, further comprising:

a plurality of lips, each one of the plurality of lips extending from an outer surface of the outer plate and at least partially surrounding a different one of the plurality of elongated outlet ports; and a plurality of lip receivers, each one of the plurality of lip receivers positioned between the conical body and a different one of the outlet pipes of the base and shaped to receive a different one of the plurality of lips.

15. The pool valve assembly of claim 14, further comprising a switch positioned on an exterior surface of the cover and operably coupled to the impeller to prevent rotation of the impeller when the switch is in a pause position.

16. The pool valve assembly of claim 15, wherein the impeller comprises a variable pitch impeller comprising a plurality of impeller blades each adjustable between a full speed forward position, a feathered position, and a full speed reverse position responsive to actuation of an actuator positioned within a housing of the impeller by a push rod extending outside the valve module.

17. The pool valve assembly of claim 15, further comprising:

a bowl-shaped shroud positioned at least partially within the slider plate and coupled to the narrow end of the slider plate, the shroud comprising a shroud opening in fluid communication with the slider plate inlet, the shroud increasing a velocity of water flow into the impeller responsive to water flowing through the slider plate inlet and the shroud opening; and a pre-swirler apparatus mounted at least partially within the shroud, the pre-swirler comprising one or more pre-swirler blades extending from an outer surface of the pre-swirler, the pre-swirling blades directing water flow into the impeller responsive to water flowing through the slider plate inlet and the shroud opening.

18. A pool valve assembly, comprising:

a valve module comprising:

an outer plate comprising a central inlet port and a plurality of elongated outlet ports each extending through a surface plane of the outer plate and having a width dimension measured in the surface plane of the outer plate smaller than its length dimension measured in the surface plane of the outer plate;

a slider plate rotatably positioned adjacent the outer plate and comprising a slider plate outlet extending through the slider plate and a slider plate inlet positioned adjacent to the inlet port of the outer plate such that the slider plate inlet and the outer plate inlet are in fluid communication; and an impeller rotatably coupled to the slider plate, the impeller rotatably responsive to water flowing into the slider plate inlet to rotate the slider plate from a first position that allows fluid communication between a first elongated outlet port of the plurality of elongated outlet ports and the slider plate outlet but prevents fluid communication between at least a second elongated outlet port of the plurality of elongated outlet port and the slider plate outlet, to a second position that allows fluid communication between the first and second elongated outlet ports and the slider plate outlet, and to at least a third position that allows fluid communication between the second elongated outlet port and the slider plate outlet but prevents fluid communication between the first elongated outlet port and the slider plate outlet.

19. The pool valve assembly of claim 18, wherein the pool valve module further comprises:

an impeller gear coupled to the impeller;

a drive train coupled to the slider plate and comprising one or more gears, the one or more gears engaged with the impeller gear and rotatable responsive to rotation of the impeller; and a ring gear coupled to the outer plate and comprising a plurality of ridges that engage with the one or more gears of the drive train as the impeller rotates the one or more gears of the drive train, the ring gear rotating the slider plate responsive to rotation of the one or more gears engaged with the plurality of ridges of the ring gear.

20. The pool valve assembly of claim 19, wherein:

the length dimension of each of the plurality of elongated outlet ports is at least two times greater than the width dimension of each of the plurality of elongated outlet ports; and the slider plate is in each of the first and third positions approximately three times longer than the second position when the impeller rotates at a substantially constant rate.

21. The pool valve assembly of claim 20, further comprising a base removably coupled to the outer plate and a cover removably coupled to at least one of the base and the ring gear, the base comprising:

a body positioned adjacent the outer plate;

an inlet pipe aligned with the inlet port of the outer plate to allow fluid communication between the inlet pipe and the inlet port; and a plurality of outlet pipes equal in number to the plurality elongated outlet ports and aligned with the plurality of outlet pipes, each outlet pipe being in fluid communication with a different elongated outlet port of the plurality of outlet ports, wherein each outlet pipe comprises a circular area equal to or less than an area of the elongated outlet port to which it is aligned.

22. The pool valve assembly of claim 21, further comprising:

a plurality of lips, each one of the plurality of lips extending from an outer surface of the outer plate and at least partially surrounding a different one of the plurality of elongated outlet ports; and a plurality of lip receivers, each one of the plurality of lip receivers positioned between the body of the base and a different one of the outlet pipes of the base and shaped to receive a different one of the plurality of lips.

23. The pool valve assembly of claim 22, further comprising an activation switch positioned on an exterior surface of the cover and operably coupled to the impeller to prevent rotation of the impeller when the switch is in a pause position, and wherein body of the base comprises a frustoconical body, the outer plate comprises a frustoconical outer plate at least partially nesting within the body of the base, and the slider plate comprises a frustoconical slider plate at least partially nesting within the outer plate.

24. The pool valve assembly of claim 23, wherein the impeller comprises a variable pitch impeller comprising a plurality of impeller blades each adjustable between a full speed forward position, a feathered position, and a full speed reverse position responsive to actuation of an actuator positioned within a housing of the impeller by a pushrod extending outside the valve module.

25. The pool valve assembly of claim 23, further comprising:

a bowl-shaped shroud positioned at least partially within the slider plate and coupled to a narrow end of the slider plate, the shroud comprising a shroud opening in fluid communication with the slider plate inlet, the shroud increasing a velocity of water flow into the impeller responsive to water flowing through the slider plate inlet and the shroud opening; and a pre-swirler apparatus mounted at least partially within the shroud, the pre-swirler comprising one or more pre-swirler blades extending from an outer surface of the pre-swirler, the pre-swirling blades directing water flow into the impeller responsive to water flowing through the slider plate inlet and the shroud opening.

26. The pool valve assembly of claim 18, further comprising a base comprising a conical body at least partially surrounding a conical outer plate, and a plurality of outlet pipes each in fluid communication with a different one of the elongated outlet ports.

27. The pool valve assembly of claim 26, further comprising a pump in fluid communication with the inlet port.

* * * * *